US005088363A

United States Patent [19]

Jones et al.

[11] Patent Number: 5,088,363

[45] Date of Patent: Feb. 18, 1992

[54] METHOD AND APPARATUS FOR AN AUTOMATIC SAWMILL

[75] Inventors: Aaron U. Jones, 1880 McLean Blvd., Eugene, Oreg. 97405; Vincent M. Howard, Eugene, Oreg.; Edward A. Kohler, Eugene, Oreg.; Mark L. Carter, Springfield, Oreg.; Edward A. Komori, Surrey; Ralph Wijesinghe, Vancouver, both of Canada; Ronald W. McGeehee, Redwood Valley, Calif.

[73] Assignee: Aaron U. Jones, Eugene, Oreg.

[21] Appl. No.: 541,092

[22] Filed: Jun. 20, 1990

Related U.S. Application Data

[63] Continuation of Ser. No. 89,489, Aug. 21, 1987, abandoned.

[51] Int. Cl.[5] ..... B27B 31/02; B27B 31/06

[52] U.S. Cl. ..... 83/35; 83/100; 83/151; 83/368; 83/808; 83/76.8; 83/404.1; 83/409.1; 144/3 R; 144/357; 144/376; 144/378

[58] Field of Search ..... 83/404, 404.1, 404.2, 83/404.3, 368, 364, 365, 360, 409, 409.1, 808, 809, 810, 811, 812, 708, 710, 711, 712, 704, 705, 27, 35, 36, 76.1, 76.8, 76.6, 76.7, 100, 730; 144/357, 367, 363, 374, 376, 378, 312, 3 R

[56] References Cited

U.S. PATENT DOCUMENTS

| | | | |
|---|---|---|---|
| 860,486 | 7/1907 | King | 83/409 X |
| 3,457,978 | 7/1969 | Ahlstedt | 144/378 X |
| 3,459,246 | 8/1969 | Ottosson | 83/808 X |
| 3,545,504 | 12/1970 | Ferrari | 83/808 X |
| 3,736,968 | 6/1973 | Mason | 144/357 |
| 3,797,349 | 3/1974 | Smith | 83/409 X |
| 4,262,572 | 4/1981 | Flodin | 144/376 X |
| 4,281,696 | 8/1981 | Howard et al. | 83/365 X |
| 4,341,248 | 7/1982 | Critchell et al. | 144/378 |
| 4,353,276 | 10/1982 | Ackerfeldt | 144/378 X |
| 4,468,992 | 9/1984 | McGeehee | 83/71 X |
| 4,491,047 | 1/1985 | Butkiewicz et al. | 83/817 |
| 4,515,196 | 5/1985 | Shields | 144/378 |
| 4,697,487 | 10/1987 | Cameron | 83/409 X |
| 4,794,964 | 1/1989 | Wolf | 144/376 X |

FOREIGN PATENT DOCUMENTS

| | | | |
|---|---|---|---|
| 951856 | 3/1964 | United Kingdom | 144/340 |
| 2031336 | 4/1980 | United Kingdom | 83/812 |

OTHER PUBLICATIONS

"Wood Mizer" catalog, Apr. 1989, Wood-Mizer Products, Inc., Indianapolis, IN.

*Primary Examiner*—Douglas D. Watts
*Assistant Examiner*—Rinaldi Rada
*Attorney, Agent, or Firm*—Dellett, Smith-Hill and Bedell

[57] ABSTRACT

In an automatic sawmill, logs are first sawn horizontally into pieces that are respectively deposited flat side down on a bed plate and conveyed through multiple, close spaced horizontal bandsaws located above the bed plate. Sawn cants are positioned by clamps to have their waney edges removed by a flying saw after clamp retraction.

38 Claims, 15 Drawing Sheets

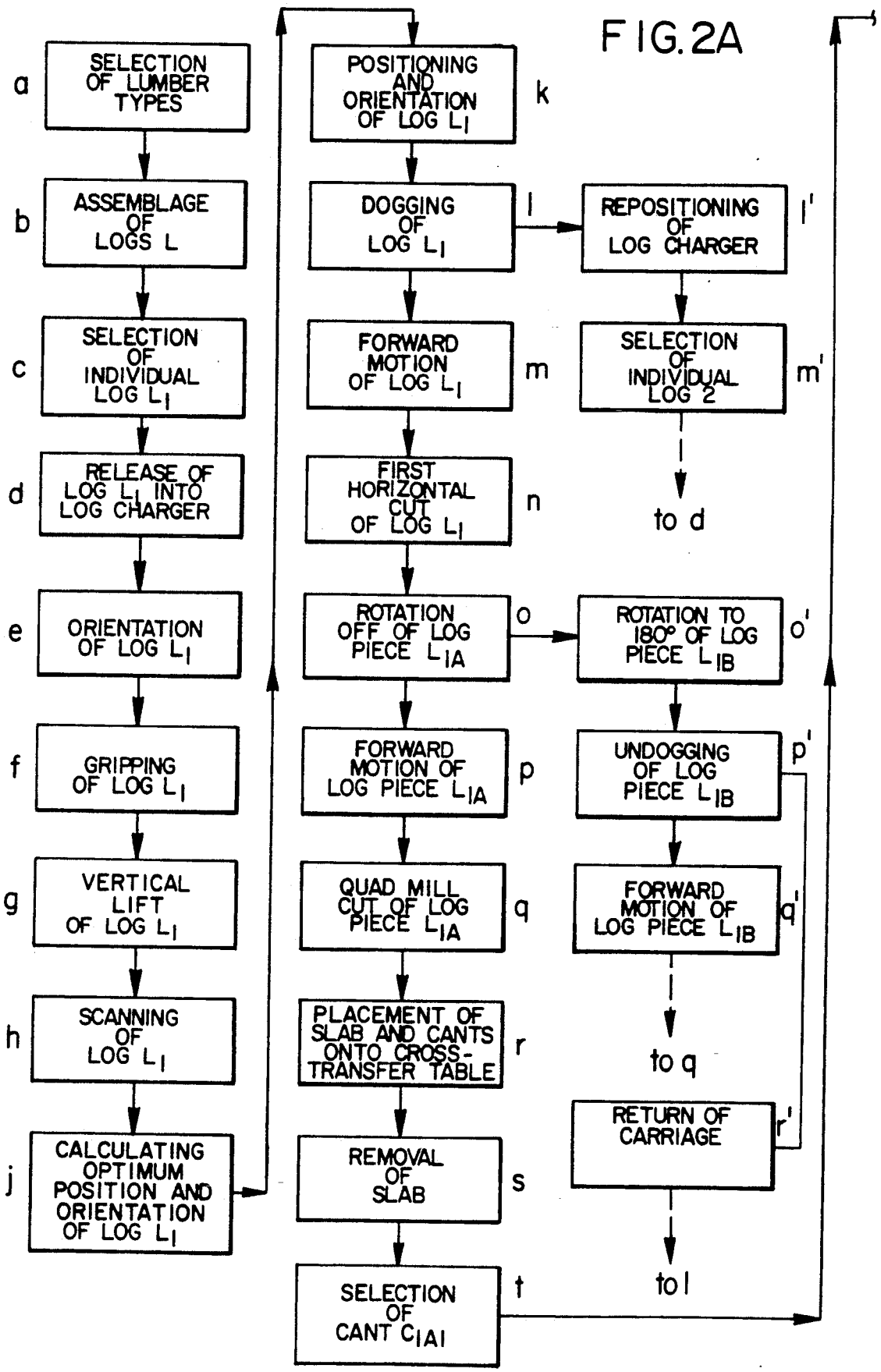
FIG. 2A
a
SELECTION OF LUMBER TYPES
b
ASSEMBLAGE OF LOGS L
c
SELECTION OF INDIVIDUAL LOG $L_I$
d
RELEASE OF LOG $L_I$ INTO LOG CHARGER
e
ORIENTATION OF LOG $L_I$
f
GRIPPING OF LOG $L_I$
g
VERTICAL LIFT OF LOG $L_I$
h
SCANNING OF LOG $L_I$
j
CALCULATING OPTIMUM POSITION AND ORIENTATION OF LOG $L_I$
k
POSITIONING AND ORIENTATION OF LOG $L_I$
l
DOGGING OF LOG $L_I$
m
FORWARD MOTION OF LOG $L_I$
n
FIRST HORIZONTAL CUT OF LOG $L_I$
o
ROTATION OFF OF LOG PIECE $L_{IA}$
p
FORWARD MOTION OF LOG PIECE $L_{IA}$
q
QUAD MILL CUT OF LOG PIECE $L_{IA}$
r
PLACEMENT OF SLAB AND CANTS ONTO CROSS-TRANSFER TABLE
s
REMOVAL OF SLAB
t
SELECTION OF CANT $C_{IAI}$
l'
REPOSITIONING OF LOG CHARGER
m'
SELECTION OF INDIVIDUAL LOG 2
to d
o'
ROTATION TO 180° OF LOG PIECE $L_{IB}$
p'
UNDOGGING OF LOG PIECE $L_{IB}$
q'
FORWARD MOTION OF LOG PIECE $L_{IB}$
to q
r'
RETURN OF CARRIAGE
to l

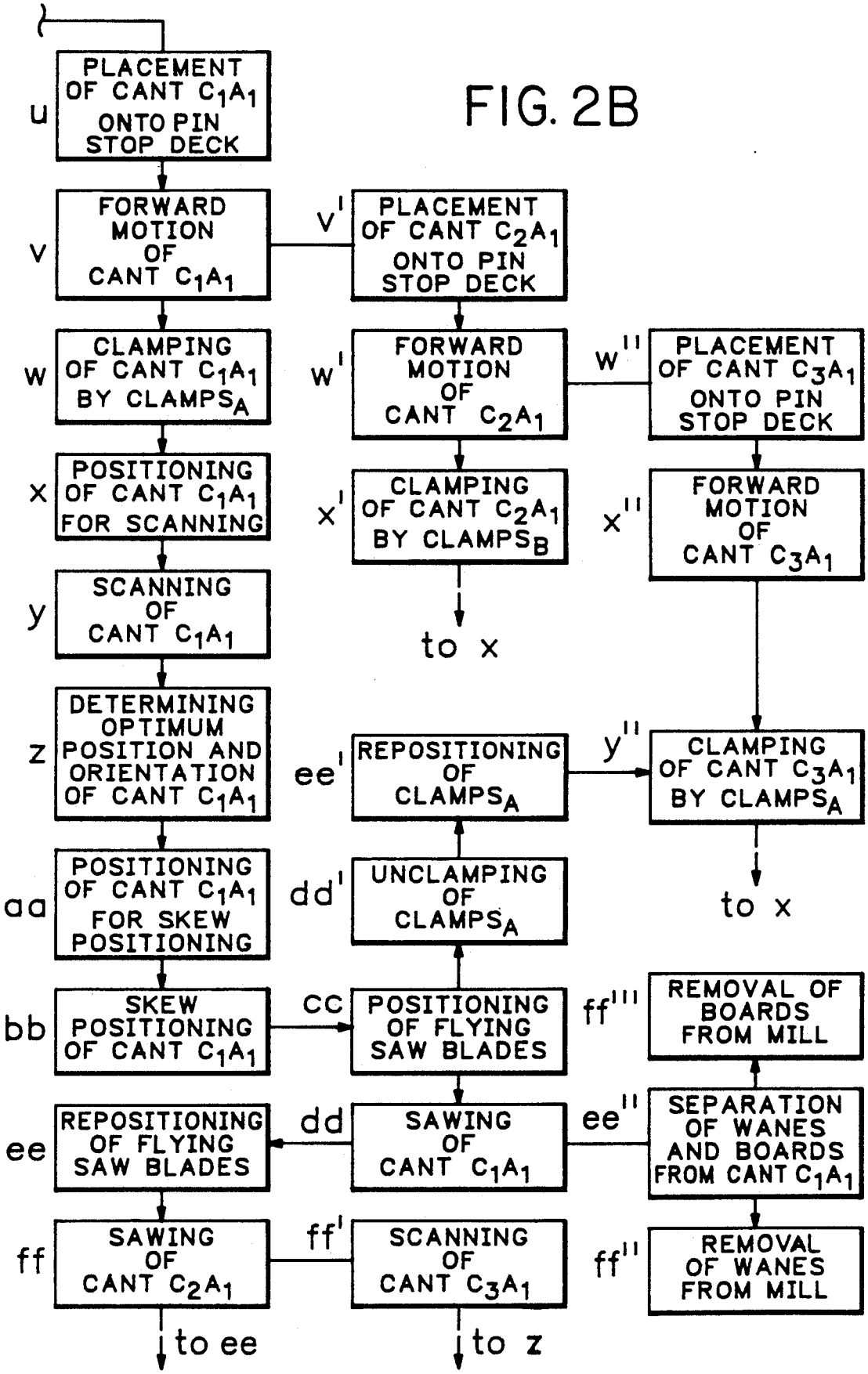
FIG. 2B
u
PLACEMENT OF CANT $C_1A_1$ ONTO PIN STOP DECK
v
FORWARD MOTION OF CANT $C_1A_1$
v'
PLACEMENT OF CANT $C_2A_1$ ONTO PIN STOP DECK
w
CLAMPING OF CANT $C_1A_1$ BY $CLAMPS_A$
w'
FORWARD MOTION OF CANT $C_2A_1$
w''
PLACEMENT OF CANT $C_3A_1$ ONTO PIN STOP DECK
x
POSITIONING OF CANT $C_1A_1$ FOR SCANNING
x'
CLAMPING OF CANT $C_2A_1$ BY $CLAMPS_B$
to x
x''
FORWARD MOTION OF CANT $C_3A_1$
y
SCANNING OF CANT $C_1A_1$
z
DETERMINING OPTIMUM POSITION AND ORIENTATION OF CANT $C_1A_1$
ee'
REPOSITIONING OF $CLAMPS_A$
y''
CLAMPING OF CANT $C_3A_1$ BY $CLAMPS_A$
to x
aa
POSITIONING OF CANT $C_1A_1$ FOR SKEW POSITIONING
dd'
UNCLAMPING OF $CLAMPS_A$
bb
SKEW POSITIONING OF CANT $C_1A_1$
cc
POSITIONING OF FLYING SAW BLADES
ff'''
REMOVAL OF BOARDS FROM MILL
ee
REPOSITIONING OF FLYING SAW BLADES
dd
SAWING OF CANT $C_1A_1$
ee''
SEPARATION OF WANES AND BOARDS FROM CANT $C_1A_1$
ff
SAWING OF CANT $C_2A_1$
ff'
SCANNING OF CANT $C_3A_1$
ff''
REMOVAL OF WANES FROM MILL
to ee
to z 242a,b
202d
208
196c
230
244a,b
240a
218b
210b
240d
212b
222b
224b
202b
216b
214b
228b
220b
200b
222b'
226b
192
198b
196b
198a
226a
200a
222a'
220a
214a
216a
228a
202b
240a
224a
196a
218a
212a
222a
194b
240b
210a
194a
202a
8
8

194b
190b
204b
182b
186b
184b
174b
226a,b
188b
180b
186b
178b
192
224a
228a
206
222a,b
210a,b
186a
178a
188a
180a
212a,b
190a
194a
204a
182a
186a
184a
174a
248b
246
240b
218a
254
246
248a
240a
248a 426a
426b
448b
458
448d
450b
412b
414b
422b
C2A1
420b
416b
418b
462a
462b
460
406
458
416a
450a
412a
414a
C1A1
420a
422a
418a
392
386
412b'
412b''
456b
452b
428b'
424b
446b
442b
444b
434b
454b
436b
428b
432b
430b
17
402a,b
512
500
506
504
498
502
474
470
480
482a
508
476a
454a
456a
412a'

METHOD AND APPARATUS FOR AN AUTOMATIC SAWMILL

This is a continuation of application Ser. No. 07/089,489 filed Aug. 21, 1987 and now abandoned.

BACKGROUND OF THE INVENTION

This invention relates to automatic sawmills, and particularly to automatic sawmills that provide multiple, simultaneous cuts on logs optimally prepositioned for maximum lumber yield.

In view of increased competition, both foreign and domestic, the modern lumber industry has had to face a new range of problems in achieving economic production. Because of the increased cost of logs, their limited availability and generally smaller sizes, it is essential to obtain as much lumber value from each log as possible. Increasing equipment and labor costs have also made it necessary to obtain that lumber efficiently and economically In addition, it has become important to limit waste, both to increase yield and for environmental reasons. These factors then make it essential to modernize the lumber-producing art.

It has become standard practice to provide some degree of automation in a sawmill whereby human intervention is minimized. Thus, automatic means have been sought that will position longitudinal cuts through a log so as to obtain the maximum amount and value of lumber. An optical system employing lights or lasers and a video camera has been used to determine the size and shape of a log, with the log then being positioned relative to one or more saws so as to provide cuts that will yield the maximum.

The typical log will have some taper and curvature, and if such a log is not optimally oriented relative to a saw, the maximum yield of lumber value cannot be obtained. Previous systems such as disc U.S. Pat. No. 3,960,041 issued June 1, 1976 to Warren et al, have used a "backstanding" method in which all cuts are made parallel to one side of the log. Alternatively, it has sometimes been the practice to rotate each log into a desired position in a manner that introduces delay in production. Systems according to the prior art have often further required a sideways motion of the log after it has been oriented and optimally rotated and it would be advantageous to provide means for positioning and/or rotating a log that introduce minimum delay.

It has been customary to measure a log or cant while in motion, which, together with mechanical inaccuracy, leads to measurement errors. Scanning systems according to the prior art have often been somewhat coarse, not taking into account the presence of knots and indentations that could yield defective lumber. It would be useful, therefore, to employ an accurate scanning process, taking place with a log or cant in a fixed position, and one that measures an extended profile of the log or cant.

When a log has been optimally positioned for sawing, it is then essential that every cut be made as accurately as possible. The close dimensional tolerances necessary to obtain as much lumber and value from a log as predicted from its dimensions are difficult to meet because of the construction and orientation of the saws, and heat generated in the sawing process due in part to sawdust accumulation. It would be useful to provide means for improving sawing accuracy to achieve predictable output.

In prior systems that have made a single initial cut on a log, error and delay can arise from the manner of handling log pieces after the initial cut. The first pieces may fall onto slat beds or another conveyor that will carry them to next saws in line, and manual rotation of a piece may be required. The lack of positive control permits errors and delays in positioning for the next cut. In addition, a slat bed or the like is not perfectly horizontal over its length making it difficult to obtain a smooth, uniform cut upon a piece carried thereby.

From a slat bed or chain transfer conveyor, each piece may undergo a series of parallel cuts, and it may be necessary to reposition either the saw or the piece after each cut in order to make the next one. During the time of movement, no lumber production occurs. One solution to this problem has been to provide a sequential line of saws, requiring substantial space. Multiple vertical band mills can also be used in which multiple saws operate on the piece at the same time. Band mills of this type would position saws both above and below the piece being cut, which results in an expensive installation and precludes access for maintenance during saw operation. Sawdust accumulation is also a problem.

After longitudinal sawing of a log, waste slabs must be removed. In order to achieve the yield of lumber expected, continued accuracy in the handling of the cants is required, and the greater the number of cants involved, the more desirable it is to continue the automated procedure. In particular, cants are desirably rescanned to permit accurate placement of subsequent cuts. In the prior art, the cants have been scanned while in motion. However, that measurement does not provide a complete profile of the cant, and log movement introduces inaccuracies. It would again be useful, therefore, to scan while the cant is not moving, and also to obtain the complete cant profile.

SUMMARY OF THE INVENTION

The sawmill of the present invention processes delimbed and debarked logs of one or more preselected lengths. Assemblages of logs $L_1$, $L_2$, . . . $L_i$, . . . $L_n$, where n is the total number of logs in an assemblage, are placed by loading means (not shown) onto a conveyor for transfer into the mill. At the end of the conveyor towards which the logs are transported, there is located a downward sloping ramp that accepts the logs so provided and feeds the logs into a singulator that selects individual logs $L_i$.

The singulator deposits each log $L_i$ in sequence onto the base of a log charger. That base includes two mutually level yoke-shaped braces located respectively near each end of the log and a third brace of lower elevation located midway therebetween. The three braces are placed colinearly on an axis that is perpendicular to and centered on a horizontal bandsaw, so that a log that falls into those braces need only be raised and moved forward to be sawed.

The braces tend to turn the log into an average optimum orientation as it falls into the log charger. More precisely, the convex side of a log that has some curvature will tend to fall into the lower center brace with the height of that brace being adjusted so as to turn that convex side to an average optimum angle. Each optimally rotated log $L_i$ is grasped by the log charger for dogging while a set of cross-bars located one near each end of the log is moved downward hydraulically until contact is made with the top of the log as sensed by photodetecting means. The vertical force thus acting on the log near each end thereof further urges the log into its desired position.

An initial measurement or "pre-scan" of the log can be obtained during the grasping process. Measurement means within the respective hydraulic mechanisms of each cross-bar can be used to indicate the position of each bar relative to the braces lying under the log. Upon the bar coming into contact with the log as indicated, the diameter of the log can be thus preliminarily established.

The charger includes two grapples located respectively near each end thereof. Each grapple comprises a set of opposed arms rotatably mounted in a fixed relationship to the cross-bars wherein the arms rotate towards the log in a linked fashion until contact. The charger then moves the log upwardly to a first scanning position.

A back lighting system is provided which is oriented generally parallel to the log at a predetermined distance and height. The system emits light in the direction of the log. By virtue of light reaching a video camera or cameras, precise measurement of the log profile is obtained which can be checked roughly with the aforementioned prescan information.

Using the data so acquired, a computer determines the optimum location and orientation of the log relative to a first horizontal bandsaw. The charger grapples move the log farther upward accordingly. This data is also used to define a next set of cuts. A pair of dogs, positioned one near each end of the log and rotatably attached to a carriage, then grip the log in a manner that will not interfere with sawing.

After the log has been dogged in the carriage, the grapple arms of the log charger open and the cross-bars move upwardly to permit entry of the next log. After the carriage has moved the first log forward, the next log falls into the log charger and is grasped as previously described.

The log carriage is offset from and runs parallel to the log charger center line. The dogs swing out from the carriage into the log charger area to grip the log. The log conveyor and singulator can be placed to allow room for a log carriage on each side of the log charger if desired whereby one log can then be positioned while another is being cut. The dogs on two such carriages may have different separations, so as to accommodate logs of different lengths.

Each dog includes a gripper that is attached through a rotary actuator to a dog arm, the latter being rotatably secured on a vertical axis to the carriage. Dogging of the log occurs by rotation of the arm so as to bring each gripper against respective ends of the log. A first horizontal bandsaw is set at a small angle to the log, and the dogs pass under the saw as the carriage transports the log therethrough.

Upon completion of a first cut, the log is rotated by a rotary actuator on each dog whereby the top, sawn piece slides off with its flat side downwardly onto a jump chain and a set of rollers that propels it onto a bed plate. Pusher bars carry the piece forward under positive control for further sawing. While the top piece is being sawn, the bottom piece is rotated to then place its flat side down, and it can then be released onto the same jump chain and rollers and placed in a landing position.

After the dog arms have sprung back to release the bottom piece, the carriage moves back to the log charger position in order to accept the next log for sawing. Having been rotated 180°, the dog grippers are in position to grip the next log. Thus, after the first log piece falls off onto the roller case and is transported forwardly and after the second log piece is released, the log carriage returns to the log charger where the next log will have been positioned and oriented by the log charger as described. A second log can then be gripped and cut immediately upon the return of the carriage whereby the log pieces from a series of such logs will follow substantially immediately after one another on the jump chain, roller case and bed plate.

Additional horizontal bandsaws, typically four in number so as to form a "quad mill", are located above and farther down the aforementioned bed plate, sequentially along a portion of its remaining length. The height of each saw above the bed plate accurately determines where each subsequent cut in the log half will be made. Those distances are established by hydraulically operated setworks mechanisms that raise or lower each saw under control of a computer or the like. The computer calculates the saw positions, or determines the positions via a look-up table, which, as in the case of the first cut, are determined from the initial log measurement so as to yield the most lumber with the highest dollar value.

A set of such data is calculated or accessed for both the top and bottom pieces of the log. The setworks mechanisms will first establish the saw heights for the top piece of the log, and after that top piece has passed through the respective saws, the heights of the four saws are reset in accordance with the data pertaining to the bottom piece.

For satisfactory saw operation, the saw heights are adjusted so that the first saw to be encountered will make the topmost cut in the log piece, and each subsequent saw will make a successively lower cut. If a log piece is of a size such that not all four saws will be required, the unneeded saw or saws can be raised above the log piece. Any saw can also be raised well above the bed plate for maintenance and saw change purposes, and the remaining saws employed as outlined above.

The saws are normally closely spaced above the bed plate and may be driven by drive wheels at either end. The drive motors of the four saws are interleaved so that the drive motors of two saws are disposed on each side of the bed plate. Even with a log piece only eight feet in length, the close spacing of the saws allows multiple saws to saw on the log piece at the same time.

Close saw spacing permits the entire quad mill to be located above the bed plate, and to be enclosed in a housing. The saws in the quad mill, as well as the initial saw, can be less complicated and much less subject to sawdust entrapment or accumulation than in the case of prior art multiple saw installations. Furthermore, the saws may be more easily changed and serviced. At the top of the aforementioned housing, above each quad mill saw, there is placed a folding trapdoor that may be opened to permit upward motion of the saw out of the housing. One or more saws may be removed for such purposes as the changing of a blade, and the trapdoor through which the saw was removed is then closed. Maintenance on the saw so removed can be conducted with safety while the remaining saws continue to operate. Access leading to the top of the housing may be provided on the housing side opposite the cutting edges of the saws, together with an enclosed working area on top of the housing. An air suction system is provided, which together with the upward positioning of the saws, reduces sawdust and lowers operating temperatures.

A cross-transfer table comprising rollers in a roll case extends beyond the aforementioned bed plate so as to receive the slabs and cants as they emerge from the sawing of each log piece. The slabs may be removed manually to a waste conveyor belt, while the cants are retained for transport onward for further sawing. One or more elongate pin stop decks that will accept individual cants are positioned at right angles to the cross-transfer table and a cant may be loaded directly onto a first pin stop deck, or may be caused to proceed farther along the cross-transfer table to a second or third pin stop deck in the event, for example, that the first pin stop deck becomes overloaded. Alternatively, cants of different thickness may be transferred to separate pin stop decks.

The continuous transfer table may thus extend to a number of perpendicularly oriented pin stop decks each containing a number of uniformly spaced sets of opposed pin stops that carry each cant away from the cross-transfer table. A track mechanism is situated between rollers of the cross-transfer table for transferring cants onto a selected pin stop deck.

The cants are suitably scanned and positioned again in order to yield the lumber as initially calculated or accessed. Clamping mechanisms associated with a dead skid at the distal end of the pin stop deck provide positive control of each cant. A cant that has traveled the length of the pin stop deck is forced onto the dead skid so as to lie across a pair of clamps. A cant is grasped by operation of clamp arms that are cammed upwardly and over the cant and then downwardly to clamp the same. The cant is then moved forwardly as hereinafter more fully described.

Each cant is brought adjacent a "flying saw" that has a scanner mounted thereon. As the flying saw cuts through one cant that has already been positioned, the scanner measures the next cant. A computer look-up or calculation determines the optimum position and orientation of that next cant, as well as the proper lateral positions of the flying saw. As the cant is moved forwardly and positioned, and possibly skewed for sawing by one set of clamps, another set moves the next following cant forward for scanning.

A first cant is grasped by a holder so that the clamps that positioned it can be released to return for a following cant. The holder then maintains the cant at a position aligned with respect to the flying saw whereby a first cant is sawn while the next following cant is scanned. A wane removal system cooperates with the saw to separate wanes and lumber.

It is accordingly an object of the present invention to provide an improved sawmill system and apparatus for producing lumber in a more efficient manner.

The foregoing and additional features and advantages of the present invention will be more apparent from the following detailed description of a preferred embodiment thereof, which proceeds with reference to the accompanying drawings.

DRAWINGS

FIG. 1 is a top plan view, in simplified form, of a sawmill according to a preferred embodiment of the present invention, FIGS. 2(*a–b*) are flow diagrams describing in block form the passage of a log and of sawn portions thereof through the sawmill of FIG. 1, FIG. 3 is an end elevational view of a singulator, log charger, scanner and log carriage of the sawmill of FIG. 1, FIG. 4 is a detailed view of the central yoke brace of FIG. 3 illustrating one manner in which its height may be adjusted, FIG. 5A is an end elevational view of the vertical lift portion of the log charger of FIG. 3, FIG. 5B is a sectional view taken along line 5B—5B in FIG. 5A, FIG. 6 is a side elevational view of the charger and log carriage components of FIG. 3, FIG. 7 is a top plan view of the carriage of FIG. 6, FIG. 8 is a sectional view taken at lines 8—8 in FIG. 7, and shows in particular an end view of one of the dogs of FIG. 7, FIG. 9 is a top plan view of a bed plate including pusher bars that feed log pieces through a quad band mill, FIG. 10 is a side elevational view of the bed plate of FIG. 9, FIG. 11 is an end elevational view of the bed plate of FIGS. 9 and 10 and the quad band mill frame, FIG. 12 is an end elevational view of the quad band mill, FIG. 13 is an end elevational view of a cross-transfer table, FIG. 14 is a side elevation view of the distal end of a pin stop deck showing the placement of the dead skid, as well as an end elevation view of the cant holder and flying saw, FIG. 15 is a plan view of the dead skid and clamps, FIG. 16 is a more detailed side elevational view of the dead skid showing its manner of cooperation with the pin stop deck and the cant holder, FIG. 17 is a detailed cross-section of a portion of the dead skid taken along the lines 17—17' of FIG. 16, and FIG. 18 is a side elevational view of a flying saw showing its manner of cooperation with the cant holder.

DETAILED DESCRIPTION

Figure 1:
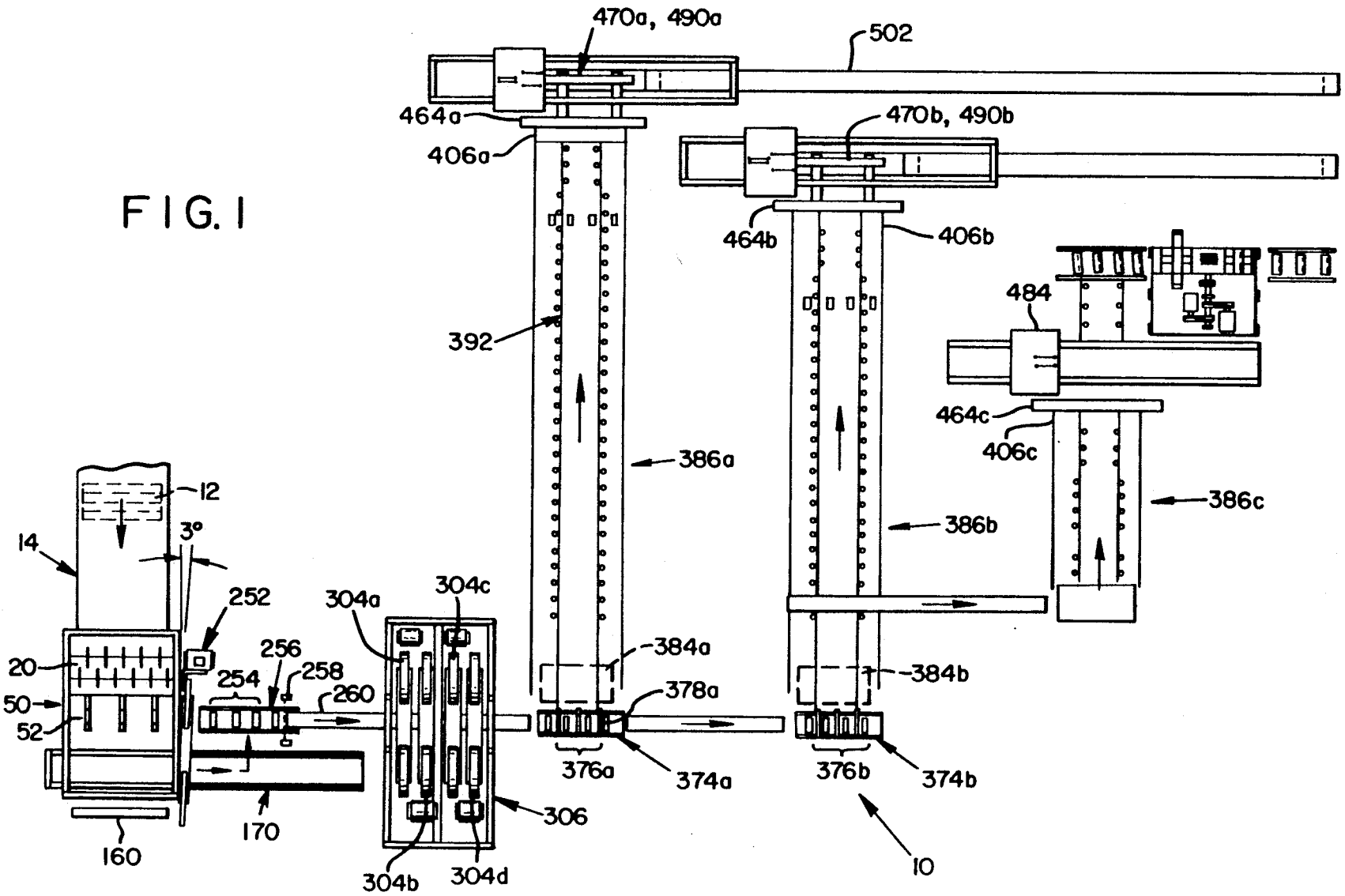

FIG. 1 is an overall plan diagram of a sawmill 10 illustrating a preferred embodiment of the apparatus of the present invention while the method by which the apparatus of FIG. 1 is employed to produce lumber is shown in the series of process steps set forth in FIG. 2. Each of those process steps is described in detail in the following description. It is assumed that step (a) of that process, which consists merely in selecting the types of lumber that sawmill 10 is to produce and providing that information to a computer as hereafter described, is carried out by means not shown.

One or more cold decks comprising stacks of logs are fed into sawmill 10. The logs will ordinarily be limbed, barked and cut into a standard length that can be accommodated by the sawmill. Assemblages 12 of logs are placed onto log conveyors 14 for transport into sawmill 10, thereby accomplishing step (b) of the process set forth in FIG. 2.

When an assemblage 12 of logs (L) has been transported into sawmill 10, step (c) of the process shown in FIG. 2 is carried out. Individual logs $L_i$ (the first of which is identified as log $L_1$ in FIG. 2) are sequentially separated from log assemblage 12 by a commercially available singulator 20, the particular features of which are not essential to an understanding of the present invention.

In step (d) of the process shown in FIG. 2, individual logs $L_i$ are then allowed to fall into log charger 50, which comprises a charger base 52 and vertical lift means 102. (See FIG. 3.) Charger base 52 includes three yoke braces 54*a*, . . . 54*c* in equally-spaced relationship along an axis that lies parallel to axles 26, 28 of the singulator, at a position to receive individual logs $L_i$. Yoke braces 54*a*, . . . , 54*c* each comprises a vertically oriented plate in the approximate shape of a right triangle having upwardly oriented log slots 56*a*, . . . , 56*c*. Yoke braces 54*a*, . . . , 54*c* depart from a right triangular shape in that altitudes 58*a*, . . . , 58*c* are terminated opposite bases 60*a*, . . . , 60*c* thereof by sides 62*a*, . . . , 62*c* that lie parallel to bases 60*a*, . . . , 60*c*. Yoke braces 54*a* and 54*c* are essentially identical in structure, but yoke brace 54*b*, located midway between yoke braces 54*a* and 54*c*, differs in that its height is adjustable as will be described in more detail below.

Yoke braces 54*a*, . . . , 54*c* are also provided with respective vertical pressure plates 64*a*, . . . , 64*c* near respective ends 66*a*, . , 66*c* opposite ends 68*a*, . . . , 68*c* of bases 60*a*, . . . , 60*c*. Situated between each pressure plate 64*a*, . . . , 64*c* and near end 70 of frame 32 and in mutual contact therewith are respective rubber air bags 72*a*, . . . , 72*c* which permit yoke braces 54*a*, . . . , 54*c* to rotate slightly about points where they are attached to brace arms 74*a*, . . . , 74*c*, in turn fixedly attached to frame 32. Bags 72*a*, . . . , 72*c* serve to absorb the shock of a log $L_i$ falling into the charger, and are sufficiently resilient to allow a minor rotation but also stiff enough to restore yoke braces 54*a*, . . . , 54*c* substantially to respective normal positions after a log $L_i$ has fallen thereon.

Figure 4:
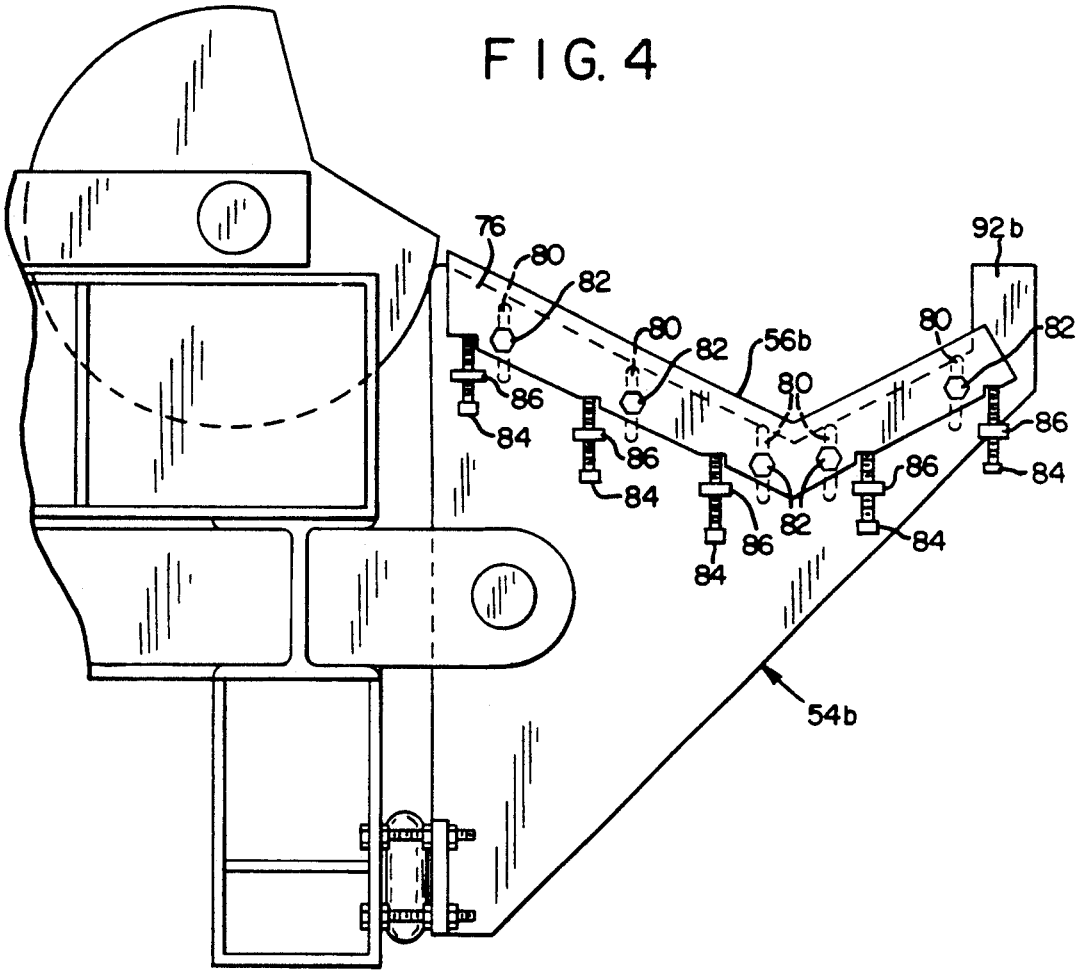

The structure of yoke brace 54*b* which permits its height to be adjusted is illustrated in FIG. 4. Log slot 56*b* is defined by a V-shaped slot bracket 76 which is slidably attached for vertical movement to the top of yoke brace 54*b*, having a lower height than the tops of yoke braces 54*a*, 54*c*. Slidable attachment is accomplished by a series of vertically oriented slots 80 near the top surface of yoke brace 54*b* and a series of circular apertures at corresponding lateral positions in slot bracket 76, through both of which bolts 82 may be passed and tightened when vertical slots 80 and the circular apertures are appropriately aligned. The height of second log slot 56*b* is fixed by placing slot bracket 76 at a desired height and then bolting slot bracket 76 and yoke brace 54*b* together.

The height at which slot bracket 76 is to be placed is selected by means of a series of adjustment bolts 84 passing upward through horizontal ears 86 that extend horizontally outward from yoke brace 54*b*. The upper ends of bolts 84 encounter underside 78 of slot bracket 76, the height of which can thus be precisely adjusted by the turning bolts 84. Upon the desired height being achieved, slot bracket 76 and yoke brace 54*b* are bolted together.

As previously stated, a log $L_i$ is allowed to fall from the singulator into log slots 56*a*, . . . , 56*c* of yoke braces 54*a*, . . . , 54*c*. Each of the slots 56*a*, . . . , 56*c* is in the shape of a "V" having a first arm 88*a*, . . . , 88*c* and a second arm 90*a*, . . . , 90*c* terminating in a vertical stop 92*a*, . . . , 92*c*.

A straight log $L_i$ that falls into log slots 56*a*, . . . , 56*c* will come to rest in some undefined rotational orientation, within yoke braces 54*a*, . . . , 54*c*. If log $L_i$ has enough curvature to exhibit an apex, and since second log slot 56*b* has a lower height, the curved log $L_i$ will tend to come to rest with the apex of that curve directed somewhat downward into second log slot 56*b*. In a preferred embodiment of the present invention, it is found that by setting the height of yoke brace 54*b* approximately one inch lower than yoke braces 54*a*, 54*c*, in most cases (approximately 80%) the plane of the log will lie at an angle of approximately 17° below the horizontal for yielding an optimum average amount of lumber. As will be seen, the structure carries out step (e) of the process shown in FIG. 2.

Figure 3:
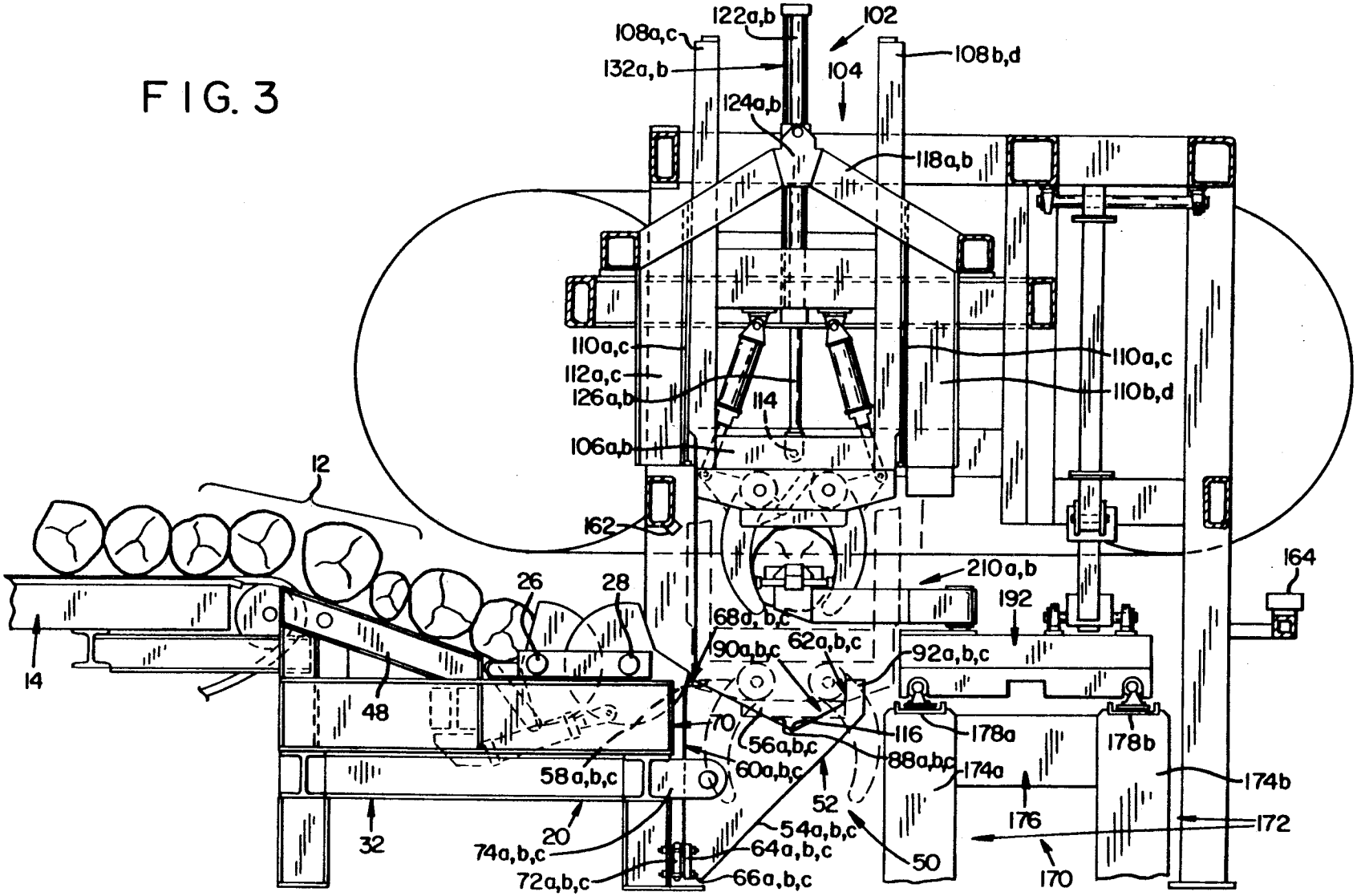

As noted in steps (f) and (g) of the process shown in FIG. 2, a log $L_i$ that falls into yoke braces 54*a*, . . . , 54*c* of charger base 52 is gripped. As shown in FIG. 3, and in greater detail in FIGS. 5*a* and 5*b*, vertical lift 102 includes a lift frame 104 within which opposite ends of lift travelers 106*a*, 106*b* are attached respectively to vertical members 108*a*, 108*b*, 108*c*, and 108*d*, comprising elongate, concavely facing U-beams of sufficient length to encompass the full range of vertical motion of lift travelers 106*a*, 106*b*. Vertical members 108*a*, 108*b* and 108*c*, 108*d* ride on tracks 110*a*, 110*b* and 110*c*, 110*d*, respectively.

Lift travelers 106*a*, 106*b* lie in a mutually parallel relationship transverse to an axis 114 that is above and parallel to a center line 116 defined as passing through the centers of log slots 56*a*, . . . , 56*c*. Lift travelers 106*a*, 106*b* are separated along line 114 by a distance somewhat shorter than the distance of separation of yoke braces 54*a*, 54*c* with the separation between lift travelers 106*a*, 106*b* being fixed. Lift travelers 106*a*, 106*b* are placed in longitudinal positions with respect to a log $L_i$ lying on yoke braces 54*a*, . . . , 54*c* that fall at approximately equal distances from opposite ends thereof.

Frame 104 includes collars 118*a*, 118*b*, each in the shape of a broad, inverted angle, that are attached at their opposite ends to corresponding vertical support members 112*a*, 112*c* and 112*b*, 112*d*, respectively. Vertical support members 112*a*, . . . 112*d* are mutually disposed so as to define an elongate horizontal rectangle, the long axis of which is fixed along axis 114.

Vertical actuators 122*a*, 122*b* pass down through, and are attached to, respective centers 124*a*, 124*b* of collars 118*a*, 118*b*, and lift rods 126*a*, 126*b* extend downwardly from within and are operated hydraulically by the respective vertical actuators 122*a*, 122*b*. Distal ends 128*a*, 128*b* of lift rods 126*a*, 126*b* are rotatably attached at center points 130*a*, 130*b* to lift travelers 106*a*, 106*b* located at axis 114. Some rotational freedom in the attachment of lift rods 126*a*, 126*b* to respective lift travelers 106*a*, 106*b* is provided to avoid binding.

Respective "Tempasonic" gauges 132*a*, 132*b* may be disposed parallel to and extending the full length of vertical actuators 122*a*, 122*b*. By magnetic means well known in the art, gauges 132*a*, 132*b* determine the positions of pistons located within vertical actuators 122*a*, 122*b*. Since lift rods 126*a*, 126*b* are of predetermined and equal length, a determination of the locations of the pistons within vertical actuators 122*a*, 122*b* represents a determination of the locations of the respective distal ends 128*a*, 128*b* of lift rods 126*a*, 126*b* and hence of lift travelers 106*a*, 106*b*. The results of such a determination can be codified in a form that can be accepted by a computer.

Attached to the respective bottom edges of lift travelers 106*a*, 106*b* are grapple brackets 134*a*, 134*b*, to which in turn are attached respective cross-bars 136*a*, 136*b*. The vertical gripping of a log $L_i$ lying in yoke braces 54*a*, . . . , 54*c* in accordance with step (f) of the process shown in FIG. 2, is accomplished by providing hydraulic fluid to vertical actuators 122a, 122b in an amount sufficient to force respective lift rods 126a, 126b downward and thereby place cross-bars 136a, 136b into contact with log $L_i$ as determined by photoelectric sensors 151. That process actually serves two purposes. The first comes about somewhat as a by-product of the structure of log charger 50. When cross-bars 136a, 136b are made to come into contact with a log $L_i$, the vertical distances by which cross-bars 136a, 136b are then separated from yoke braces 54a, . . . , 54c can be used as a measurement of the dimensions of log $L_i$ In fact, vertical actuators 122a and 122b operate independently of one another and may achieve different vertical separations from yoke braces 54a, . . . , 54c in the case of a tapered log. Two measurements of the dimensions (i.e., thickness) of log $L_i$ are thus obtained, at distances from opposite ends thereof corresponding to the positions along line 114 (or 116) of lift travelers 106a, 106b. The second purpose in causing cross-bars 136a, 136b to contact log $L_i$ is to bring about some additional rotational orientation of log $L_i$. Photoelectric means 151 mounted on the log chargers serve to terminate the transfer of hydraulic fluid to actuators 122a, 122b and thus to terminate the vertical descent of cross-bars 136a, 136b at a predetermined log engaging position.

Additional rotation of log $L_i$ will occur in particular if log $L_i$ has a degree of twist. As previously described, a curved log $L_i$ desirably tends to fall into log-slots 56a, . . . , 56c of yoke braces 54a, . . . , 54c in a position such that a plane bisecting log $L_i$ through the apex of that curvature will lie at an angle of 17° below the horizontal. If log $L_i$ also includes a degree of twist, one end or the other of log $L_i$ will tend to point upward. By exerting equal downward forces on log $L_i$ near opposite ends thereof, cross-bars 136a, 136b will tend to orient log $L_i$ such that a horizontal plane therethrough that separates log $L_i$ into portions containing equal amounts of wood will pass as close as possible to the vertical center of log $L_i$ Longitudinal sawing of a log made parallel to such a plane has been found to produce an optimized yield.

The log $L_i$ is also engaged by grapples. For this purpose, vertical lift 102 includes grapple travelers 138a, 138b, that are attached to vertical travelers 108a, 108b and 108c 108d. Grapple actuators 142a, . . . , 142d are rotatably attached at respective proximal ends 144a, . . . , 144d to and extend downward from grapple travelers 138a, 138b, by means of respective couplers 146a, . . . , 146d. The construction of couplers 146a, . . . , 146d is such as to permit limited rotation of grapple actuators 142a, . . . , 142d in a vertical plane. Grapple actuators 142a, . . . , 142d receive proximal ends of respective grapple rods 148a, . . . , 148d that are attached to pistons therein (not shown) in the manner of vertical actuators 122a, 122b. The distal ends of grapple rods 148a, . . . , 148d are rotationally connected to respective grapple plates 150a, . . . , 150d, at horns 152a, . . . , 152d that extend upwardly therefrom. Grapple plates 150a, 150b are rotationally attached in a spaced-apart horizontal relationship to grapple bracket 134a, as are also grapple plates 150c, 150d to grapple bracket 134b.

A grapple arm 154a is fixedly attached to grapple plate 150a at a point opposite grapple plate horn 152a, grapple arm 154a being arcuate in shape and narrowing towards the distal end thereof. Grapple arm 154a is oriented with its concave side facing corresponding grapple arms 154b, 154c that are similarly shaped and correspondingly attached to grapple plate 150b such that the concave sides thereof face grapple arm 154a. Grapple arms 154b, 154c are mutually displaced a predetermined distance along a line parallel to line 114, said distance being sufficient to allow grapple arm 154a to pass between grapple arms 154b and 154c when grapple arm 154a and grapple arms 154b, 154c are rotated towards one another. This interleaving serves to provide a closing together of the ends of the respective grapple arms that will inhibit twisting.

Grapple arms 154d, . . , 154f are similarly attached to grapple plates 150c and 150d in corresponding relationships to grapple plate horns 152c and 152d. Each grapple bracket provides rotational support to three grapple arms, one on one side thereof and two on the other, the respective sides thereof that support either one or two grapple arms being reversed between the two brackets.

Figure 5A:
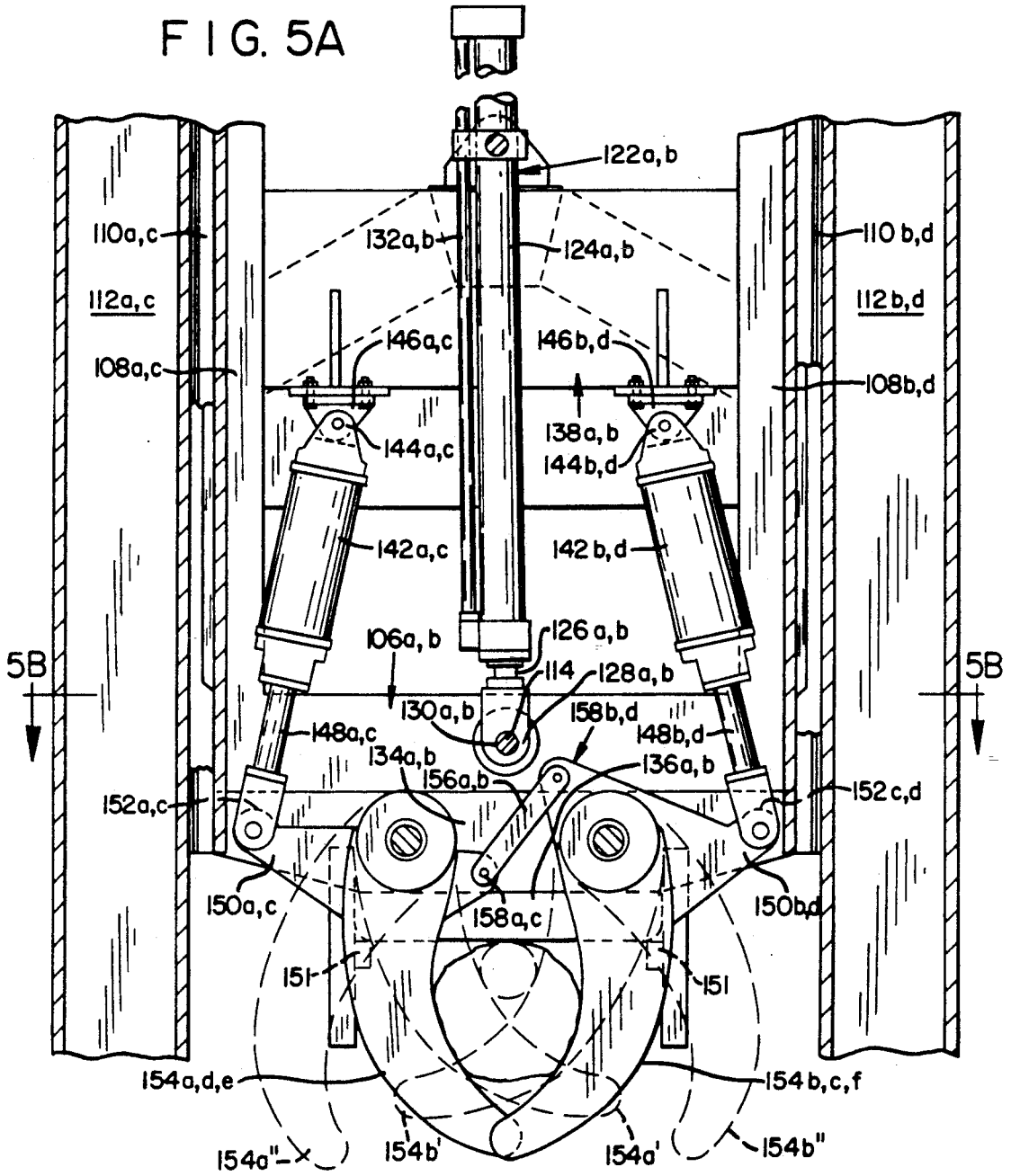
Figure 5B:
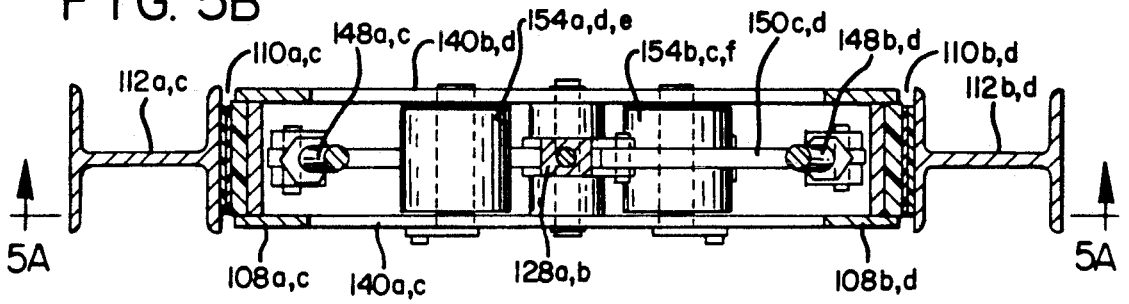

Horizontal gripping of log $L_i$ is accomplished by providing of hydraulic fluid to grapple actuators 142a, . . . , 142d sufficient to cause outward motion therefrom of grapple rods 148a, ., 148d to rotate grapple arm 154a and arms 154b, 154c, and likewise arms 154d, 154e and 154f, towards one another so as to grip log $L_i$ FIG. 5A, for example, in addition to showing arms 154a, . . . , 54f as holding a log $L_i$, also illustrates in outline arms 154a', 154b' as holding a much smaller log, and arms 154a'', 154b'' as being open.

Rotation of grapple plates 150a, . . . , 150d is not entirely independent, but coupled together. I.e., grapple plates 150a and 150b are interconnected by linkage 156a, and grapple plates 150c and 150d are interconnected by linkage 156b. Linkages 156a, 156b are rotatably connected at opposite ends thereof to respective plates 150a, 150b and 150c, 150d at respective apexal points 158a, 158b and 158c, 158d thereon near the proximal ends of grapple arms 154a, . . . , 154c, and likewise grapple arms 154d, . . . , 154f.

Grapple actuators 142a, . . . , 142d suitably incorporate pressure sensing means that serve to terminate the flow of hydraulic fluid thereto when the force of contact between grapple arms 154a, . . . , 154f and log $L_i$ has reached a predetermined level. Since it is that force which holds log $L_i$ with sufficient strength to allow the lifting thereof, the force level must be set high enough to provide the holding strength required.

As shown at step (h) in FIG. 2, log $L_i$ is scanned before sawing, and then the optimum position for sawing that will yield the most lumber can be ascertained. Scanner means 160 suitably employs a "light curtain" comprising a row of lights 162 and one or more cameras 164, at known positions relative to log charger 50, that are directed towards the log. The process provides the measurement in a somewhat conventional manner, the measurement data so obtained being encoded and supplied to a computer that has been programmed to provide the optimum cutting program or access a predetermined cutting schedule for a given sized log. The "prescan" dimensions obtained from the vertical distances between cross-bars 136a, 136b and yoke braces 54a, . . . , 54c may provide a check upon the dimensions as provided from the light scan.

Step (g) of FIG. 2 indicates that log $L_i$ is to be lifted vertically, and the aforementioned scanning, step (h), is accomplished at an intermediate stationary vertical position of the grapples. As indicated in FIG. 2 as step (j), a computer calculates or accesses a vertical position and orientation at which the elongate cylinder of a log $L_i$ must be placed in order that a horizontal sawing plane identified by the computer will lie at a predetermined vertical height at which the log can be cut. The computer program selects such a plane as will leave an amount of space thereunder sufficient for log $L_i$ to be dogged. Since the nature of the taper that log $L_i$ has been ascertained, the computer program will determine the vertical orientation that each end of log $L_i$ must have, i.e., the heights at which both ends of the log are to be placed.

As shown in FIG. 2, step (k), it then becomes necessary to move log $L_i$ into the desired position and orientation. Since the original position and orientation of log $L_i$ are known, the amount by which it must be raised in order to place log $L_i$ into the desired position and orientation is easily determined. That is, the distances that both of cross-bars 136*a*, 136*b* were moved downward in order to grip log $L_i$ are known. The height at which a first horizontal cut of log $L_i$ can be made is also known and it is then straightforward to calculate the distances cross-bars 136*a*, 136*b* must be moved back up in order to achieve a height and orientation of log $L_i$ at which the preferred plane therethrough corresponds to the sawing height. The extent of actual motion caused by vertical actuators 122*a*, 122*b* can be measured by length gauges 132*a*, 132*b*. Vertical actuators 122*a*, 122*b* bring about the appropriate vertical motion.

The sawmill that embodies the present invention thus places the log in an optimum position for sawing and then provides dogging of the log that permits such sawing to be carried out. The dogging of log $L_i$ for sawing indicated at step (1) of FIG. 2 is provided by log carriage 170 illustrated in FIGS. 3, 6, 7 and 8. As can best be seen in FIG. 3, log carriage 170 has, as a principal component, carriage pedestal 172, which includes pedestal legs 174*a*, 174*b*, which in the preferred embodiment are formed from concrete and extend parallel to and are displaced transversely from log charger 50.

Carriage tracks 178*a*, 178*b* comprise relatively wide and shallow U-beams and extend upward from the top surfaces of pedestal legs 174*a*, 174*b*. As can be seen in greater detail in FIG. 8, track plates 180*a*, 180*b* comprise elongate rectangular plates located on carriage tracks 178*a*, 178*b*, respectively. Respective shims 182*a*, 182*b* are positioned as needed between tracks 178*a*, 178*b* and track plates 180*a*, 180*b* for the full length thereof, and provide means for insuring that track plates 180*a*, 180*b* are level along their length. Pairs of set screws 184*a*, 184*b* are placed at spaced locations along the length of carriage tracks 178*a*, 178*b* and are supported through spurs 186*a*, 186*b* that extend upward from carrier tracks 178*a*, 178*b*. The height of set screws 184*a*, 184*b* is established so as to coincide with the height of track plates 180*a*, 180*b*. By adjusting the depth of penetration of set screws 184*a*, 184*b*, force may be applied to either side of track plates 180*a*, 180*b*, thereby providing means for insuring track plates 180*a*, 180*b* lie precisely in a given horizontal direction.

Rail mounts 188*a*, 188*b*, which are basically pyramidal in cross section but which are somewhat broader at the base, are attached atop respective track plates 180*a*, 180*b* and extend continuously the full length thereof. Rails 190*a*, 190*b*, circular in cross section and somewhat wider than rail mounts 188*a*, 188*b*, are attached on the top surfaces of mounts 188*a*, 188*b*. As can best be seen in FIG. 6, rails 190*a*, 190*b* extend sufficiently far to allow a log $L_i$ to be sawn for its full length.

Figure 7:
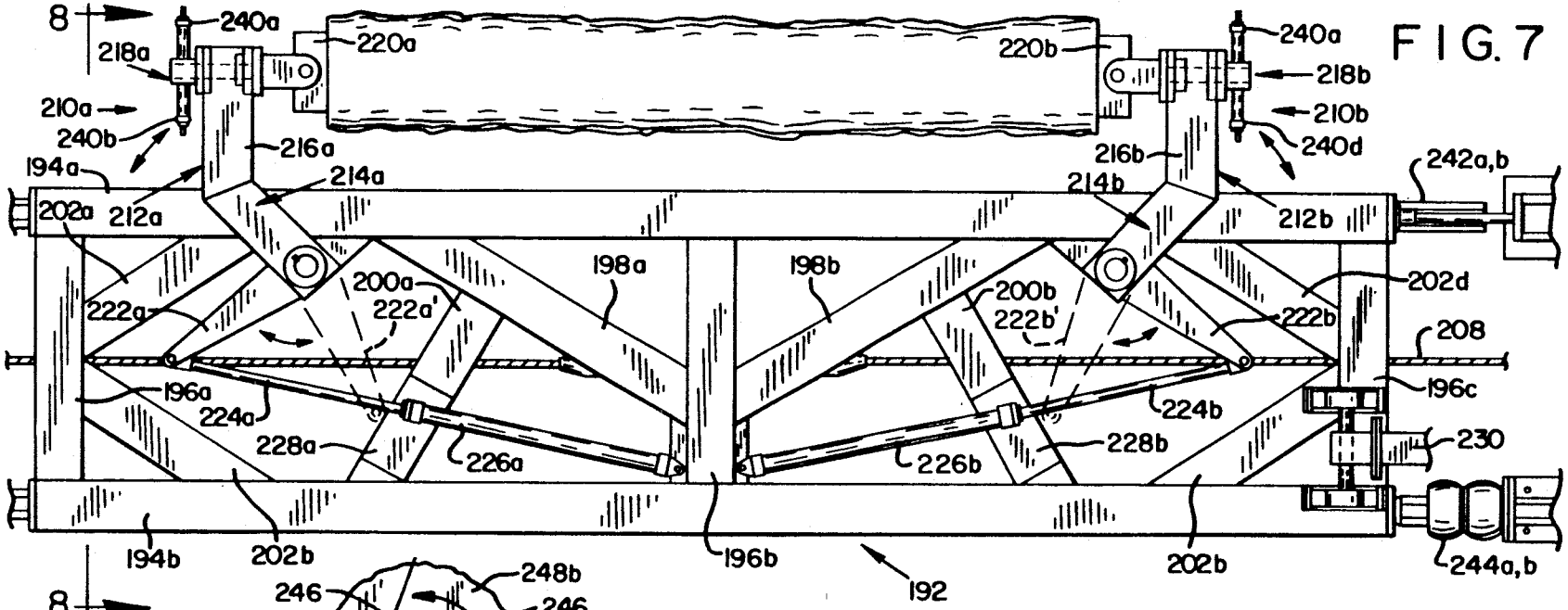
Figure 8:
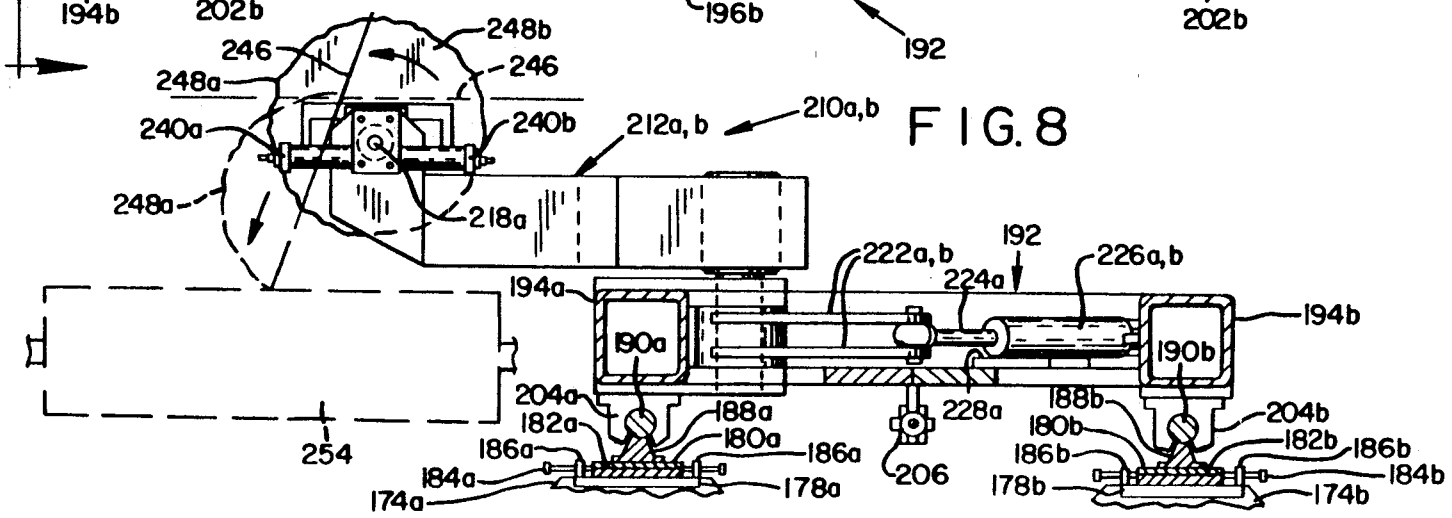

As shown in detail in FIGS. 7 and 8, the carriage 192 rests atop rails 190*a*, 190*b* and includes horizontal frame members 194*a*, 194*b* on opposite sides thereof, as well as horizontal cross-members 196*a*, . . . , 196*c* at opposite ends and at the center between frame members 194*a*, 194*b*. First diagonal supports 198*a*, 198*b* are attached between opposite sides of center cross-member 196*b* and longitudinal frame member 194*a* at points approximately midway between the center and the respective ends thereof. Second diagonal supports 200*a*, 200*b* are attached to the sides of respective first diagonal supports 198*a*, 198*b* at respective points thereon that are just past the longitudinal centers thereof in the direction of frame member 194*a*. Distal ends of second diagonal supports 200*a*, 200*b* are attached to the side of frame member 194*b*. Third diagonal supports 202*a*, 202*b* and 202*c*, 202*d* are located between respective facing sides of cross-members 196*a*, 196*c* and respective facing sides of frame members 194*a*, 194*b* at the corners of the structure. In combination, the first diagonal supports 198*a*, 198*b*, second diagonal supports 200*a*, 200*b*, and third diagonal supports 202*a*, . . . , 202*d* provide bracing strength in the form of a truss for carriage 192.

Figure 6:
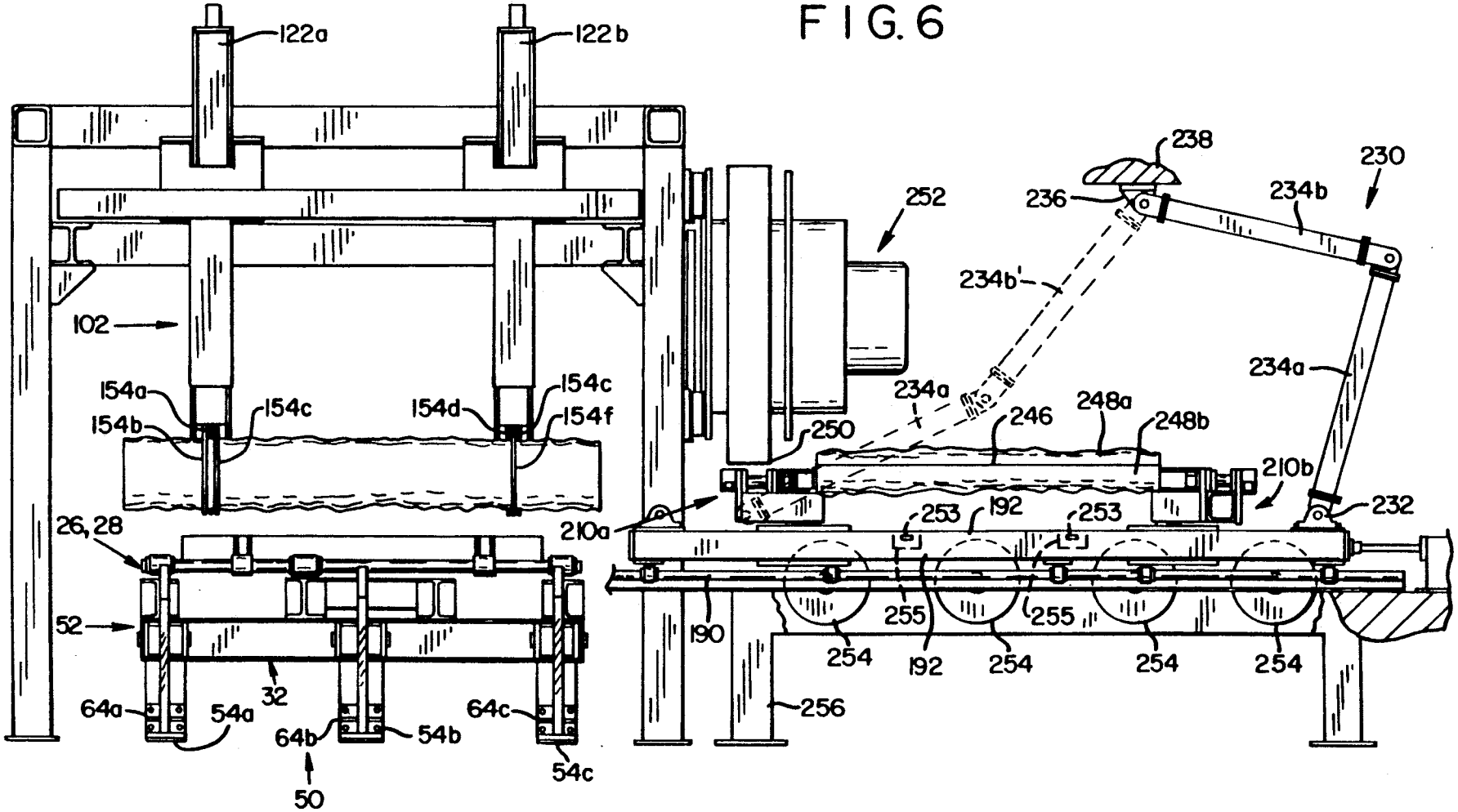

As can best be seen in FIGS. 6 and 8, carriage 192 is slidable along rails 190*a*, 190*b* via a number of downwardly extending rail clamps 204*a*, 204*b*, respectively, that are attached along the length of respective frame members 194*a*, 194*b* and encircle three-quarters of respective rails 190*a*, 190*b*. Cable locks 206 permit attachment of cable 208 to carriage 192 so that it may be pulled in either direction along rails 190*a*, 190*b*.

As illustrated in FIGS. 7 and 8, dogs 210*a*, 210*b* are rotatably attached to the carriage 192 through respective dog arms 212*a*, 212*b* proximate opposite ends of carriage 192, near the sides thereof that are closest to log charger 50. Dog arms 212*a*, 212*b* include respective first segments 214*a*, 214*b* by means of which rotational attachment to carriage 192 is made, and, respectively joined thereto at angles of approximately 45°, respective second segments 216*a*, 216*b*. To the latter are joined, at distal ends thereof, respective rotary actuators 218*a*, 218*b*. At a time when dogs 210*a*, 210*b* are positioned within log charger 50 for holding a log, first segments 214*a*, 214*b* point outward from carriage 192 at an angle of approximately 45° in the direction of respective ends of carriage 192, while second segments 216*a*, 216*b* point generally perpendicular to carriage 192. Dog grippers 220*a*, 220*b* are supported in mutually facing relationship (when dogs 210*a*, 210*b* are positioned as just stated within log charger 50), as attached to rotary actuators 218*a*, 218*b*. Dog grippers 220*a*, 220*b* are caused to rotate about respective axes disposed horizontally through centers thereof by the rotary actuators 218*a*, 218*b*. Such rotation is suitably empowered hydraulically under remote computer control.

Dog rotation arms 222*a*, 222*b*, each comprising a pair of arms vertically displaced in a mutually facing relationship, are joined to respective segments 214*a*, 214*b* at the points of rotational attachment thereof to carriage 192 and at angles of approximately 90° thereto in the direction of the longitudinal center of carriage 192. Rotation rods 224*a*, 224*b* are coupled at proximal ends thereof to respective distal ends of dog rotation arms 222*a*, 222*b* while forming part of respective actuators 226*a*, 226*b*. Activation of actuators 226*a*, 226*b* causes longitudinal movement of rods 224*a*, 224*b*, thereby causing rotation of respective arms 212*a*, 212*b* and hence of dog grippers 220*a*, 220*b* into or out of the region of log charger 50. Dog rotation arms 222*a*', 222*b*' are shown in dashed lines in FIG. 7 in positions corresponding to a rotation of respective dogs 210*a*, 210*b* out of the region of log charger 50. Skid pads 228*a*, 228*b* of an appropriately hard and smooth material are located on the upper surfaces of second diagonal supports 200*a*, 200*b* over a sufficient length thereof underlying distal ends of dog rotation actuators 226*a*, 226*b* to provide a vertically supporting surface on which the latter may slide since said distal ends are caused to swing in a horizontal arc as they act upon rotation arms 222*a*, 222*b*.

The relative sizes of rods 224*a*, 224*b* and the pistons (not shown) to which they are attached in actuators 226*a*, 226*b* are established so that rotation of arms 212*a*, 212*b* into the region of log charger 50 occurs with substantial force, thereby causing firm gripping of log $L_i$ by dog grippers 220*a*, 220*b*, while conversely the rotation of dog arms 212*a*, 212*b* out of the region of log charger 50 occurs with substantial speed, thereby permitting the quick release of a log.

As illustrated in FIG. 6, an upwardly extending service arm 230 is attached by service arm coupler 232 to the top of and near the leading end of carriage 192. Service arm 230 includes first segment 234*a* rotatably connected to carriage 192 via coupler 232 and to segment 234*b* pivotally attached via coupler 236 to overhead structure 238. As shown by dashed segment labelled 234*b*' in FIG. 6, service arm 230 follows the motion of carriage 192 as it moves back and forth parallel to log charger 50, and provides continuous connection for furnishing hydraulic fluid and/or electricity to the carriage.

In a hydraulic embodiment, hydraulic fluid is provided to dog rotation actuators 226*a*, 226*b*, and also to rotary actuators 218*a*, 218*b* at hydraulic connection points 240*a*, 240*b*, 240*c*, 240*d* as shown in FIG. 7. Both types of actuator can be of well known design and need not be discussed further.

As noted, movement of dog arms 212*a*, 212*b* into the region of log charger 50 will place dog grippers 220*a*, 220*b* into contact with a log $L_i$ carried by the charger, and will provide the gripping that permits log $L_i$ to be carried forward. As soon as dogging occurs, grapple arms 154*a*, . . . , 154*f* release log $L_i$, again suitably under computer control or other sequential operating control. As indicated in FIG. 2 at step (1'), log charger 50 is returned to its original configuration in which lift travelers 106*a*, 106*b* are at the top of their motion and grapple arms 154*a*, . . . , 154*f* are fully open. As shown in FIG. 2 as step (m'), the next log $L_{i+1}$ or ($L_2$) is selected by singulator 20, with the process shown as beginning at step (d) of FIG. 2 being repeated for that next log. In this way, a continuous series of logs $L_i$ is brought forward.

The function of log carriage 170 is controlled to grip each log $L_i$ in its optimum position and orientation as determined by the charger, and then to carry it forward for sawing. The latter function comprises step (m) in FIG. 2 and is performed due to the action of cable 208 which is fixedly attached to carriage 192 at connector 206. Cable 208 is pulled in both directions by a conventional electrical motor (not shown).

In FIG. 6, the first horizontal cut 246 of log $L_i$ into a first (top) log piece 248*a* and a second (bottom) log piece 248*b* is illustrated as having been made. That process comprises step (n) as shown in FIG. 2. In that sawing process, dogs 210*a*, 210*b* lie below the level of cut 246 and hence of the cutting height of blade 250 of a first horizontal band saw 252 as log $L_i$ passes therethrough. Horizontal band saw 252 may be of known design but is preferably of the type described and claimed in the copending application of Wijesinghe et al, Ser. No. 022,096, filed Mar. 5, 1987, and entitled "Bandmill"; the copending application of Wijesinghe et al., Ser. No. 151,803, filed Feb. 3, 1988, entitled "Bandmill with Automatic Track and Strain Control System"; The copending application of Wijesinghe et al., Ser. No. 020,985, filed Mar. 2, 1987, entitled "Automatic Bandmill Strain and Saw Tracking Method and Apparatus"; or the copending application of Wijesinghe et al, Ser. No. 259,482, filed Oct. 19, 1988, and entitled "Automatic Bandmill Strain and Saw Tracking Method and Apparatus". Band saw 252 is disposed above the carriage and in general above the path of the carriage and the log carried thereby. As illustrated in FIG. 1, the band of first horizontal band saw 252 is oriented at a horizontal angle of 3°, to a line normal to the direction of motion of log $L_i$. That orientation permits the teeth of band saw 252 to encounter the leading end of log $L_i$, not all at once but rather successively. Entry of those saw teeth into the log is thus eased, accuracy is improved, and the sawing process is faster. Thus, vibrations that could affect the accuracy of the cut are minimized.

Upon carriage 192 having carried log $L_i$ through saw 252, top piece 248*a* is removed for further sawing by activation of the rotary actuators 218*a*, 218*b*. That part of the process corresponds to step (o) in FIG. 2. Log $L_i$ is rotated about the common axis of dog grippers 220*a*, 220*b* that passes through log $L_i$ until top piece 248*a* slides off bottom piece 248*b*, which occurs when log $L_i$ has rotated approximately 70°. This action is illustrated at the left in FIG. 8. Top piece 248*a* falls off sideways, with its flat side down, upon a set of transverse jump chains 253 positioned in vertically movable channels 255, which first receive piece 248*a*. Channels 255 are lowered and chains 253 propel piece 248*a* sideways against an edge of roller case 256, the latter being provided with propulsion rollers 254. Propulsion rollers 254 are motor driven for propelling log pieces forward (to the right in FIG. 6) away from first horizontal band saw 252. The jump chains are lowered (by means not shown) so that a piece can be moved by the roller case.

As indicated in FIG. 2 as step (o'), after top piece 248*a* has fallen onto propulsion rollers 254, dog grippers 220*a*, 220*b* complete rotation through 180° so that bottom piece 248*b* becomes oriented with its flat side down. When the top piece has been rolled out from under the bottom piece, channels 255 located in partially enclosing relation to chains 253 are moved upwardly by conventional means to receive the rotated bottom piece and, as indicated at step (p') of FIG. 2, bottom piece 248*b* is undogged by the retraction of dog rotation actuators 226*a*, 226*b*. Carriage 192 returns to the area of log charger 50 to receive the next log $L_{i+1}$ to repeat occurrence of steps (l) and (m) as previously described and continuing steps (d), . . . , (k), thus supplying a continuous stream of logs to first horizontal band saw 252. Channels 255 are lowered to deposit the bottom piece on chains 253 which propel the piece toward roller case 254. Then chains 253 lower and the bottom piece 248*b* is propelled to the right by the roller case.

Figure 9:
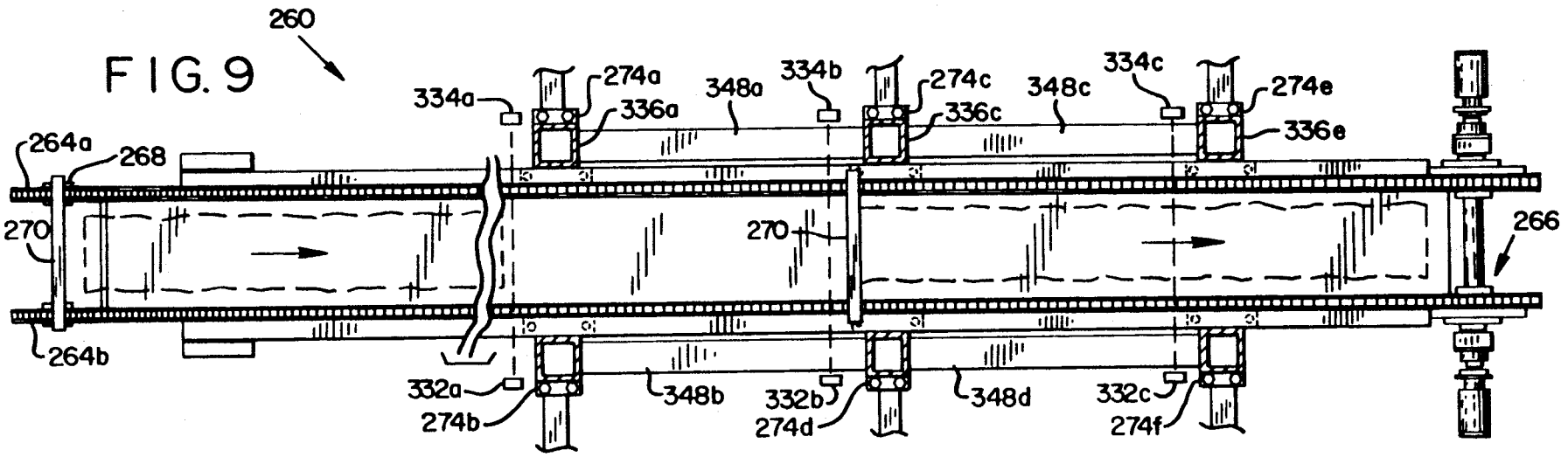
Figure 10:
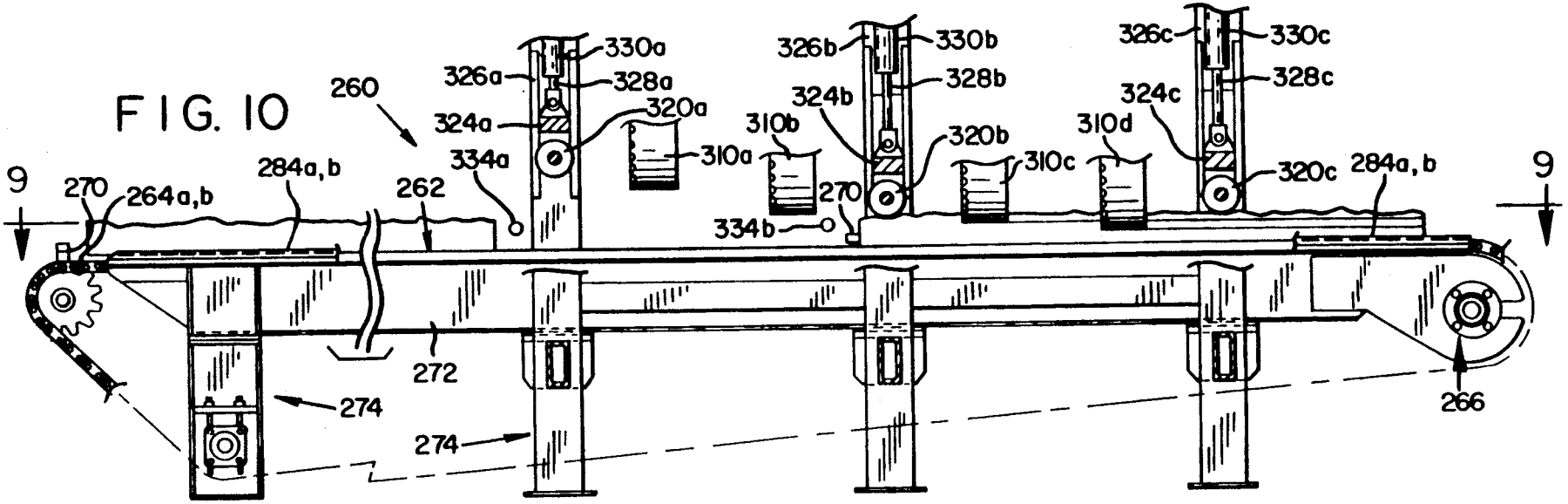
Figure 11:
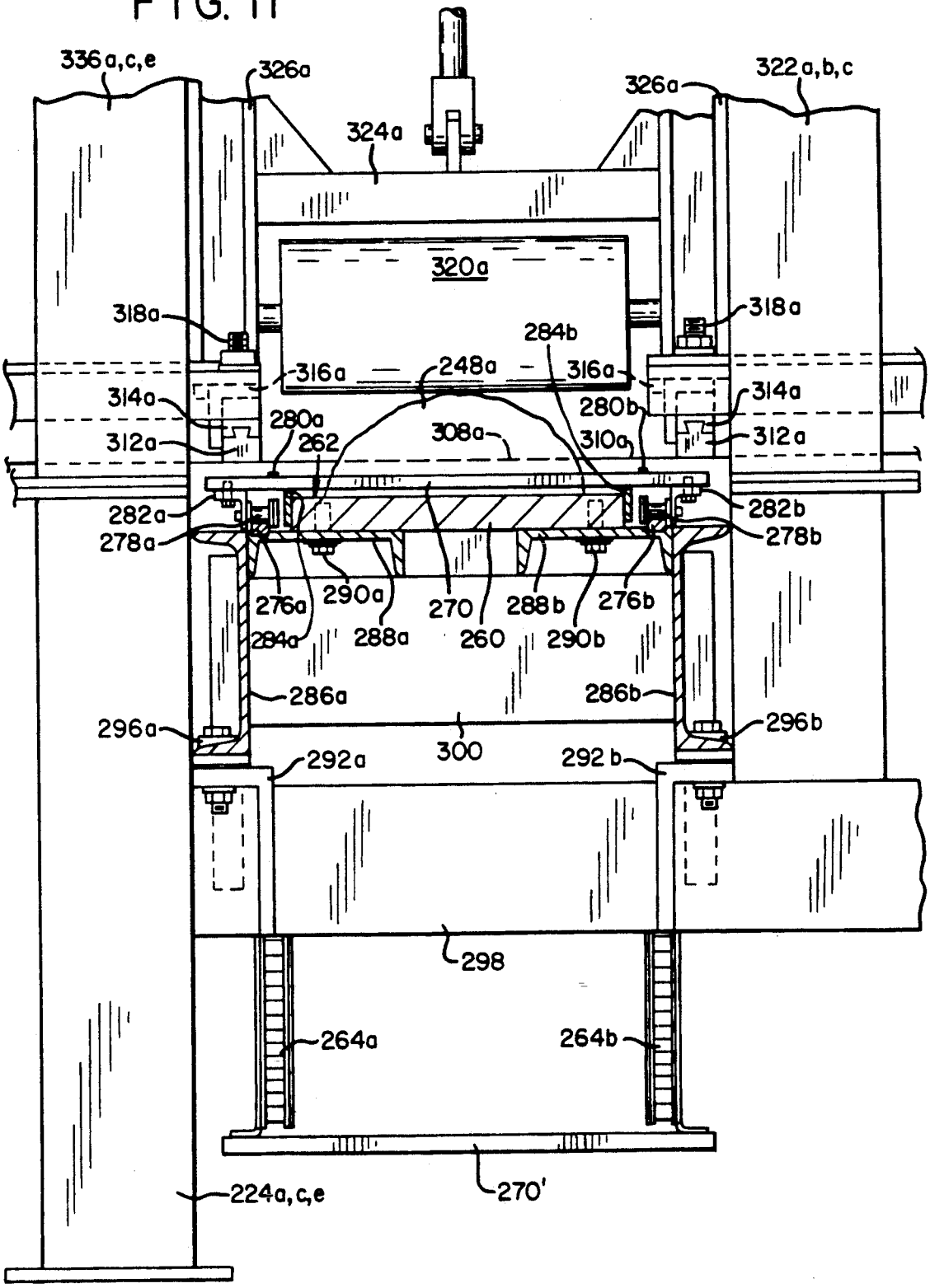

Continuing with step (p) of FIG. 2, piece 248*a* is propelled forward by propulsion rollers 254 onto bed plate 260 which extends colinearly therefrom as shown in FIG. 1. Bed plate 260 has an upper surface 262 as shown in FIGS. 9, 10 and 11 which receives piece 248*a* (and all subsequent log pieces) flat side down. Surface 262 is precisely machined so as to maintain the vertical position of a log piece thereon to a very close tolerance as it moves down bed plate 260.

As further illustrated in FIGS. 9 and 10, continuous chains 264a, 264b extend the full length of bed plate 260 on each side thereof and are driven by a motor assembly 266 at the distal end. At the proximal end of bed plate 260, chains 264a, 264b ride over sprockets 268 on a shaft disposed transversely to bed plate 260. A number of pusher bars 270 (three in the constructed embodiment) are connected transversely between chains 264a, 264b at mutually facing positions thereon so that pusher bars 270 will lie at right angles to the long dimension of bed plate 260. Rotation of motor assembly 266 and hence of sprockets 268 is such as to propel pusher bars 270 away from roller case 256 when they are positioned above bed plate 260.

Bed plate 260 is provided with a bed plate frame 272 supported in part by inner legs 274a, 274b. As shown in FIG. 11, bed plate frame 272 includes pusher tracks 276a, 276b respectively located near each side thereof. Track riders 278a, 278b comprising smooth rods of a length sufficient to span the width of pusher tracks 276a, 276b are located near opposite ends of pusher bars 270 and are horizontally attached between chain links and brackets 282a, 282b. Pusher tracks 276a, 276b are of a sufficiently hard and smooth material to permit track riders 278a, 278b to slide along the surface thereof as pusher bars 270 move along bed plate 260. Vertical support is thus provided to the chain links to prevent pusher bars 270 from touching and possibly marring surface 262. A pusher bar 270' in a return flight position on its way up to surface 262 is also shown in FIG. 11.

While surface 262 and pusher bars 270 cooperate to insure a smooth and positively controlled forward progress of a log piece on surface 262, since the cuts to be made on the log piece as it continues onward are all horizontal, it is not essential that the log piece be precisely aligned with bed plate 260. However, it is necessary to insure that a log piece will not slide off either side of bed plate 260. Therefore, the bed plate 260 is provided with edges 284a, b to prevent a log piece from sliding off bed plate 260 especially when it engages a saw.

As further seen in FIG. 11, the structure of the bed plate frame includes vertical beams 286a, 286b to which are attached horizontal beams 288a, 288b, respectively, upon the top surfaces of which respective tracks 276a, 276b are mounted. Bed locks 290a, 290b pass vertically through horizontal beams 288a, 288b, respectively, and serve to hold bed plate 260 in place. Vertical beams 286a, 286b stand above respective posts 292a, 292b and are separated therefrom by shims, the selection of which allows the height of bed plate 260 to be precisely adjusted, and at a level approximately corresponding to that of propulsion rollers 254. Surface 262 is thus enabled to control precisely the vertical position of each log piece. Vertical beams 286a, 286b are fixedly attached to posts 292a, 292b, respectively, by bolt assemblies 296a, 296b when the shimming operation has been completed.

Figure 12:
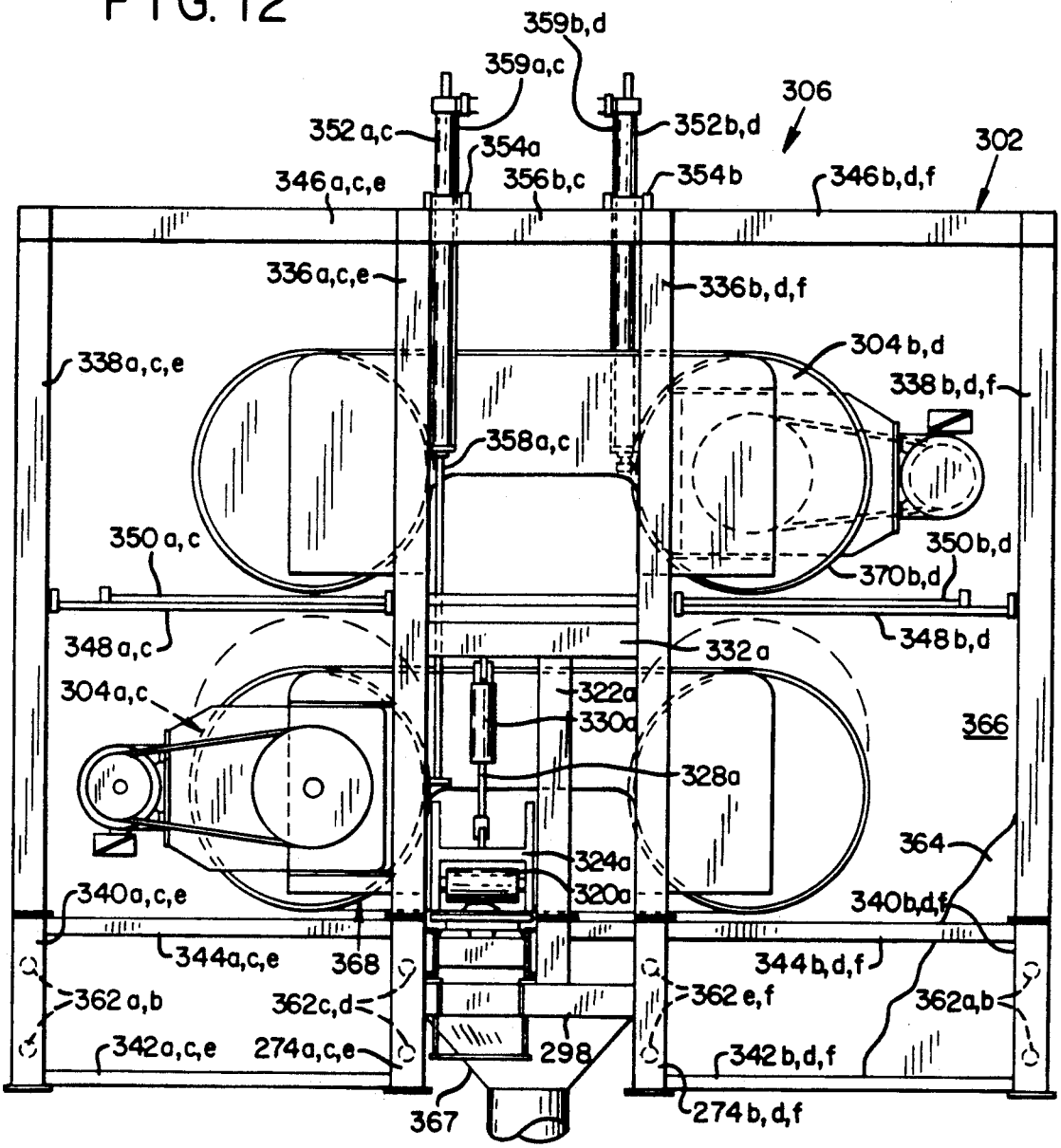

As illustrated in FIG. 12, inner leg 274a is immediately adjacent the bed plate and inner leg 274b is separated therefrom. Posts 292a, 292b which help to support beams 286a, 286b (in FIG. 11) are attached to first cross beam 298, which extends between inner legs 274a, 274b and also a substantial distance away from post 292b. Beams 286a, 286b are further interconnected by a second cross beam 300. Inner legs 274a, 274b form part of a much larger structure 302 serving to house a set of four horizontal band saws 304a, . . . , 304d, shown in FIG. 1 as quad mill 306.

As the aforementioned top log piece 248a is moved forwardly along bed plate 260, to carry out step (q) of the process shown in FIG. 2, it is subjected to horizontal cuts by quad mill 306. As multiple cuts of top piece 248a in step (q) occur, the undogging of bottom piece 248b shown as step (p') of FIG. 2 also takes place, followed by the forward motion of bottom piece 248b in step (q'). The return of carriage 192 to grip the next log additionally follows the undogging of bottom piece 248b.

Referring to FIGS. 10, 11 and 12 horizontal band saw 304a is in position to carry out a cut by means of saw band 310a (FIG. 11) at line 308a passing through top log piece 248a. The height of saw band 310a is determined by the vertical positions of a pair of saw guides 312a. Pairs of singular saw guides are likewise associated with band saws 304b, . . . , 304d. Saw guides 312a are slidably attached to respective guide holders 314a and guide holders 314a are secured to pairs of mutually facing guide supports 316a by guide bolts 318a. Similar saw guide supporting structure is also associated with the remaining band saws. The band saws of the quad mill are narrow and closely spaced so at least three of the bandmills can cut an eight foot log piece at the same time.

The height of any saw band 310a, . . . , 310d (FIG. 10) and hence the height at which a cut will be made (and indeed whether a cut will be made at all) is determined by the positions of respective band saws 304a, . . . , 304d. In FIG. 12, for example, band saws 304b and 304d are shown as positioned above the log piece. FIG. 10 illustrates saw band 310a as above an approaching log piece (since the log piece is of small height above surface 262), saw band 310b as slightly above a preceding log piece, while saw bands 310c and 310d are in this case making first and second cuts on the preceding log piece.

In order for each cut to be made with the accuracy required, the log piece should be held at a precise, even height. Smooth surface 262 on which the log piece is to slide is provided by bed plate 260, but it is also desirable that the log piece be held firmly down onto bed plate 260 and this function is accomplished by a series of hold-down rollers 320a, . . . , 320c. As shown in FIG. 11, for example, hold-down roller 320a is adapted to contact the upper surface of top piece 248a. Hold-down roller 320a is rotatably mounted in hold-down bracket 324a, which is slidable in a pair of vertical ways 326a. Movement of hold-down rollers 320a, . . . , 320c is effected by hold-down rods 328a, . . . , 328c (FIG. 12), respectively attached to the upper ends of hold-down brackets 324a, . . . , 324c and extending downward from and operated by respective pneumatic actuators 330a, . . . , 330c fixedly attached to cross-beams such as beam 332a in FIG. 12. Hold-down actuators 330a, . . . , 330c provide a downward force upon a log piece at a predetermined pressure, yet the compressibility of the air by which hold-down actuators 330a, . . . , 330c operate permits the rollers to "ride over" imperfections in the upper surface of the log piece held onto bed plate 260.

Referring to FIGS. 9 and 10, hold-down actuators 330a, . . . , 330c are suitably operated by respective photocell systems 334a, . . . , 334c or similar means which bring rollers 320a, . . . , 320c downward just after the presence of a log piece interrupts a light beam.

Rollers 320*a*, . . . , 320*c* move back upward when the motion of the log piece along bed plate 260 has taken it beyond the respective photocell systems.

As illustrated in FIG. 12, elongate inner upper legs 336*a*, . . . , 336*f* are positioned above inner legs 274*a*, . . . , 274*f*. Hold-down ways 326*a*, . . . , 326*c* (FIG. 11) are mounted in a facing relationship between inner upper legs 336*a*, 336*c*, 336*d* on one side and center beams 322*a*, . . . , 322*c* on the other. Additional structural elements include upper legs 338*a*, . . . , 338*f* which respectively rest upon outer legs 340*a*, . . . , 340*f*. Lateral support to saw structure 302 is provided by base lateral members 342*a*, . . . , 342*f* and upper lateral members 344*a*, . . . , 344*f* respectively interposed between facing ends of corresponding legs 274*a*, . . . , 274*f* and 340*a*, . . . , 340*f*. Furthermore, top lateral beams 346*a*, . . . , 346*f* are respectively interposed between facing upper ends of corresponding upper legs 336*a*, . . . , 336*f* and 338*a*, . . . , 338*f*.

Nearly midway up corresponding pairs of respective upper legs 336*a*, . . . , 336*f* and 338*a*, . . . , 338*f* are movable ceilings 348*a*, . . . , 348*d* that can be swung upwardly to permit one or more of horizontal band saws 304*a*, . . . , 304*d* to be moved thereabove, the area between laterally facing pairs of upper legs 336*a*, . . . , 336*f* at that height being otherwise clear. Alternatively, each of such ceilings may be fixed, and may incorporate trap doors located therein. In either case, a saw may be moved upwardly for maintenance purposes, entirely away from the sawing area near bed plate 260, and can then be closed off so that work on the saw can be carried out safely.

Vertical movement of band saws 304*a*, . . . , 304*d* is accomplished by hydraulically operated saw lift actuators or setworks 352*a*, 352*c* and 352*b*, 352*d*, which are vertically mounted in respective saw lift beams 354*a*, 354*b* that are disposed longitudinally across top center beams 356*a*, . . . , 356*c* attached between respective facing sides of upper legs 336*a*, . . . , 336*f* at the top of structure 302. Saw lift rods 358*a*, . . . , 358*d* extend downwardly from and are operated by respective saw lift actuators or setworks 352*a*, . . . , 352*d*. The distal ends of lift rods 358*a*, . . . , 358*d* are attached to respective band saws 304*a*, . . . , 304*d* for adjustably positioning the same in the vertical direction.

As previously indicated, upon scanner means 162–164 having measured the dimensions of a log $L_i$, a determination is made via computation or a lookup table to determine or access the height of a first horizontal cut 246 therein, and also the additional horizontal cuts to be made in the log pieces 248*a*, 248*b* for producing optimum output. The vertical distance between saw lift actuators 352*a*, . . . , 352*d* and bed plate surface 262 is known. Respective saw lift gauges 359, . . . ,359*c* are suitably provided to determine the distance of travel of saw lift rods 358*a*, . . . , 358*d* below saw lift actuators 352*a*, . . . , 352*d* and hence the height above bed plate surface 262, at which each saw band is located, can be set. Each such height is adjusted to be appropriate for sawing each individual log piece. The process may involve one or more of the band saws 304*a*, . . . , 304*d*, but in any event requires a log piece to traverse the length of quad mill 306 under the force of a pusher bar 270 and constitutes step (q) of the process illustrated in FIG. 2. It will be observed that the horizontal positioning of the quad mill saws provides for more accurate and cleaner sawing with respect to the bed plate, as well as easy positioning of a saw for servicing while the remaining saws may be programmed to provide the desired saw cuts. The saws can also be located close together, to cut the same log piece, with drive motors located on alternate ends thereof as illustrated in FIG. 1. Although band mills 304*a*, . . . , 304*c* may be of known types, the preferred form is as set forth in the aforementioned Wijesinghe et al application, Ser. No. 022,096, filed Mar. 5, 1987; the copending application of Wijesinghe et al, Ser. No. 151,803, filed Feb. 3, 1988, entitled "Bandmill with Automatic Track and Strain Control System"; the copending application of Wijesinghe et al, Ser. No. 020,985, filed Mar. 2, 1987, entitled "Automatic Bandmill Strain and Saw Tracking Method and Apparatus"; or the copending application of Wijesinghe et al, Ser. No. 259,482, filed Oct. 19, 1988, and entitled "Automatic Bandmill Strain and Saw Tracking Method and Apparatus".

The repeated passage of log pieces through quad mill 306 will generate considerable heat, particularly in respect to the sawing process itself. That heat may cause thermal expansion of the materials such as elements from which bed plate 260 and saw lift gauges 359*a*, . . . , 359*d*, etc. are formed, so as to affect the accuracy with which sawing can be accomplished. Since the ability to obtain the optimum amount of lumber depends upon this accuracy, it becomes important to remove as much heat as possible. Therefore, since many structural members of quad mill 306 are hollow, means for passing cooling water through those members is suitably provided. For the sake of clarity, only a limited number of such means are shown in FIG. 12, i.e., includinq openings 362*a*, . . . , 362*h* for piping passing through convenient sides of inner legs 274*a*, 274*b* and outer legs 340*a*, 340*b*. Connection thereto of an external water source and pump (not shown) then permits the quad mill to operate at a more constant temperature whereby errors in setting the positions of cuts within a log piece are minimized. The concrete base upon which the quad mill is ultimately supported is also desirably maintained at a constant temperature in a similar manner.

The portion of quad mill 306 that is below ceiling 348 is desirably surrounded by walls. A housing 366 is thereby formed. The purpose of the walls is to minimize the spread of sawdust created in the operation of quad mill 306. In addition, the structure of quad mill 306, wherein all of the band saws 304*a*, . . . , 304*d* are located above bed plate 260, permits the addition of a vacuum system, shown as including vacuum outlet 367 in FIG. 12. It is desirable for accurate sawing that the sawdust be thus removed.

Figure 13:
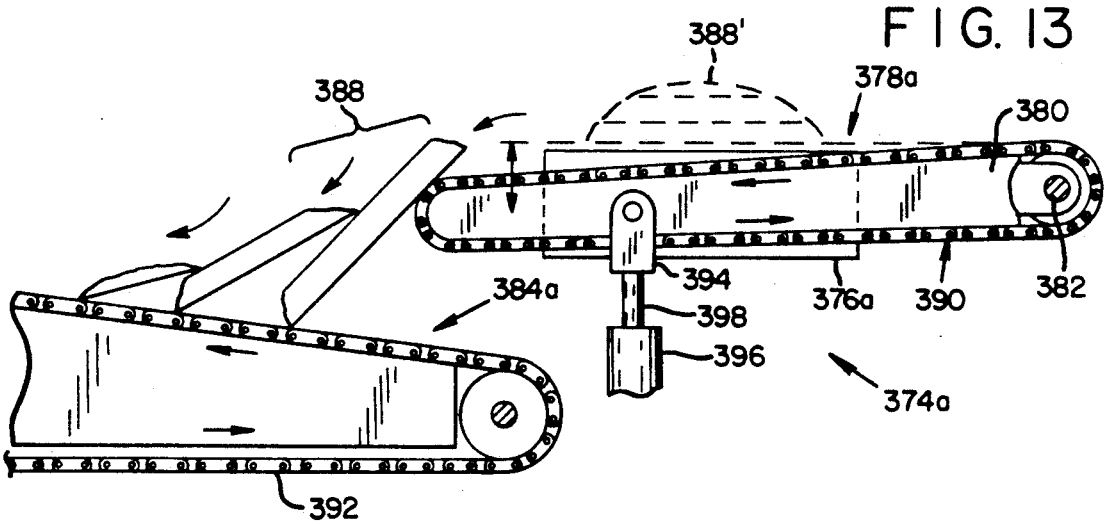

As shown in FIG. 1, cross-transfer table 374*a* is located at the distal end of bed plate 260 and serves to receive the cants and slabs that emerge from quad mill 306 by virtue of the continued motion of pusher bars 270 so as to accomplish step (r) of the process in FIG. 2. Cross-transfer table 374*a* is of a well known type and of the same basic form as roller case 254, and includes cross-transfer rollers 376*a*, one of which is shown in FIG. 13. Rollers 376*a* rotate under power so as to propel the cants and slabs forwardly, but cross-transfer table 374*a* includes means for removing those cants and slabs laterally. Specifically, cross-transfer table 374*a* includes a set of transversely oriented track arms 378*a*, each having a body 380 rotatably attached to cross-transfer table 374*a* on axle 382. Track arms 378 lie parallel to and are interleaved with rollers 376. Cant deck 384*a* extends downwardly from pin stop deck 386*a* so that the distal end of cant deck 384*a* is below facing distal ends of track arms 378*a*, for transferring selected cants or slabs 388 from cross-transfer table 374*a* onto the pin stop deck. Track arm 378*a* includes continuous cross-transfer friction chain 390 of known design driven in the direction indicated by the arrows.

A track lift coupler 394 is rotatably attached to track arm 378*a* at a point thereon separated from axle 382 by a distance of approximately ⅔ the length of track arm body 380, and hydraulic track lifter 396 is coupled to track lift coupler 394 by track lift rod 398. Hydraulic operation of track lifter 396 rotates track arm 378*a* upwardly in a clockwise direction to cause transfer of cants and slabs 388 from cross-transfer table 374*a* onto a cant deck 384*a* of pin stop deck 386*a* where they are transported onward by conveyor 392.

In operation, track arms 378*a* are rotated upwardly so as to sequentially contact the bottom of a set of cants and slabs 388' as shown in outline in FIG. 13, which are thereby transported sequentially to the distal end of track arms 378*a* by movement of cross-transfer friction chain 390. If track arms 378*a* are not rotated upwardly as described, the action of cross-transfer rollers 376*a* will cause any such cants and slabs to continue onward along cross-transfer table 374*a* to be transferred to subsequent pin stop deck 386*b* by means of corresponding mechanism 374*b*–384*b*, or to pin stop deck 386*c* via a similar mechanism.

As indicated in FIG. 2, step (s) of the process includes removal of the slab produced by the topmost cut on a log piece. Also, step (t) requires the selection of a first cant from top piece 248*a* designated $C_1A_1$. In the present apparatus, slabs may be removed manually either before or after cants and slabs 388 have fallen onto a cant deck 384. Steps (s) and (t) of the process shown in FIG. 2 are accomplished in that cants produced from a log piece, such as top piece 248*a*, become separated into a sequence $C_1A_1$, $C_2A_1$, $C_3A_1$ by action of an arm 378, while action of deck 384 in placing the cants onto a pin stop deck 386 also accomplishes step (u) of the FIG. 2 process.

Figure 14:
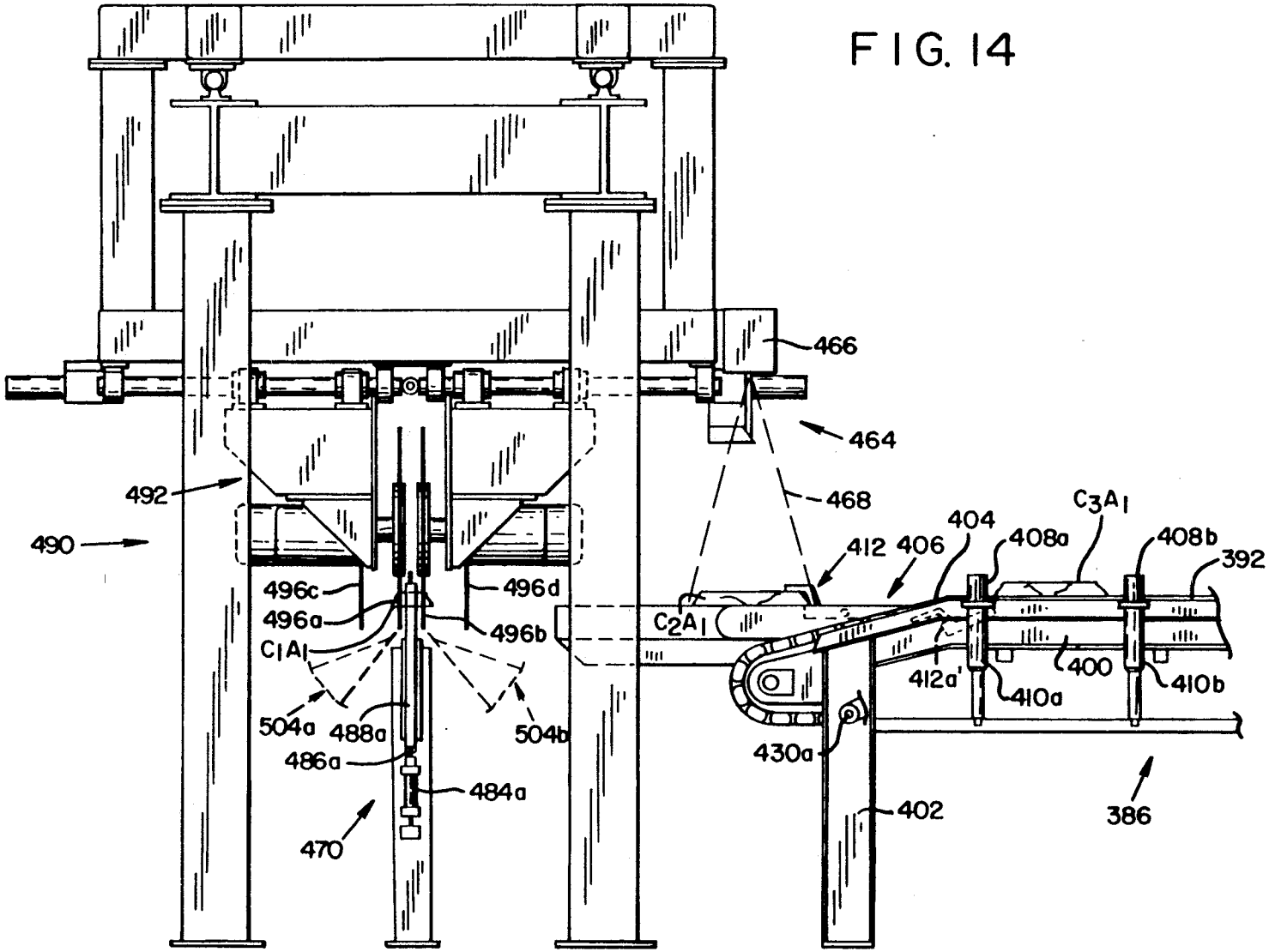

FIG. 14 illustrates in brief the end of a pin stop deck remote from a cross-transfer table 374. Pin stop deck 386 includes a frame 400 supported on legs 402 and over the full length of which passes a conveyor 392. At the distal end of a pin stop deck is located a downward sloping off-load deck portion 404 that leads to dead skid 406. It is the function of pin stop deck 386 to transport forwardly the cants placed thereon by track arms 378 and transport them in timed relation so they will arrive at the off-load deck portion 404 at intervals to be picked up by dead skid 406. This forward motion accomplishes step (v) of the process described in FIG. 2.

As illustrated in FIG. 1, each pin stop deck 386 includes at spaced intervals along the top surface thereof, and immediately adjacent conveyor 392, a plurality of mutually facing pin stop pairs, a representative pin stop being shown in FIG. 14 at 408. Each pin stop is contained within a corresponding sleeve 410 for guiding vertical movement thereof. In particular, each pin stop 408 can be moved upwardly within a corresponding sleeve so as to intercept the forward motion of a cant moving along conveyor 392, or alternatively downwardly to allow such a cant to pass. The general function and operation of pin stop decks are well known and require no further discussion. Cants $C_1A_1$, $C_2A_1$ and $C_3A_1$ are shown in FIG. 14 with their respective positions indicated. The third cant in sequence, i.e., cant $C_3A_1$, is illustrated as being located between pin stops 408*a* and 408*b*.

Figures 15, 16:
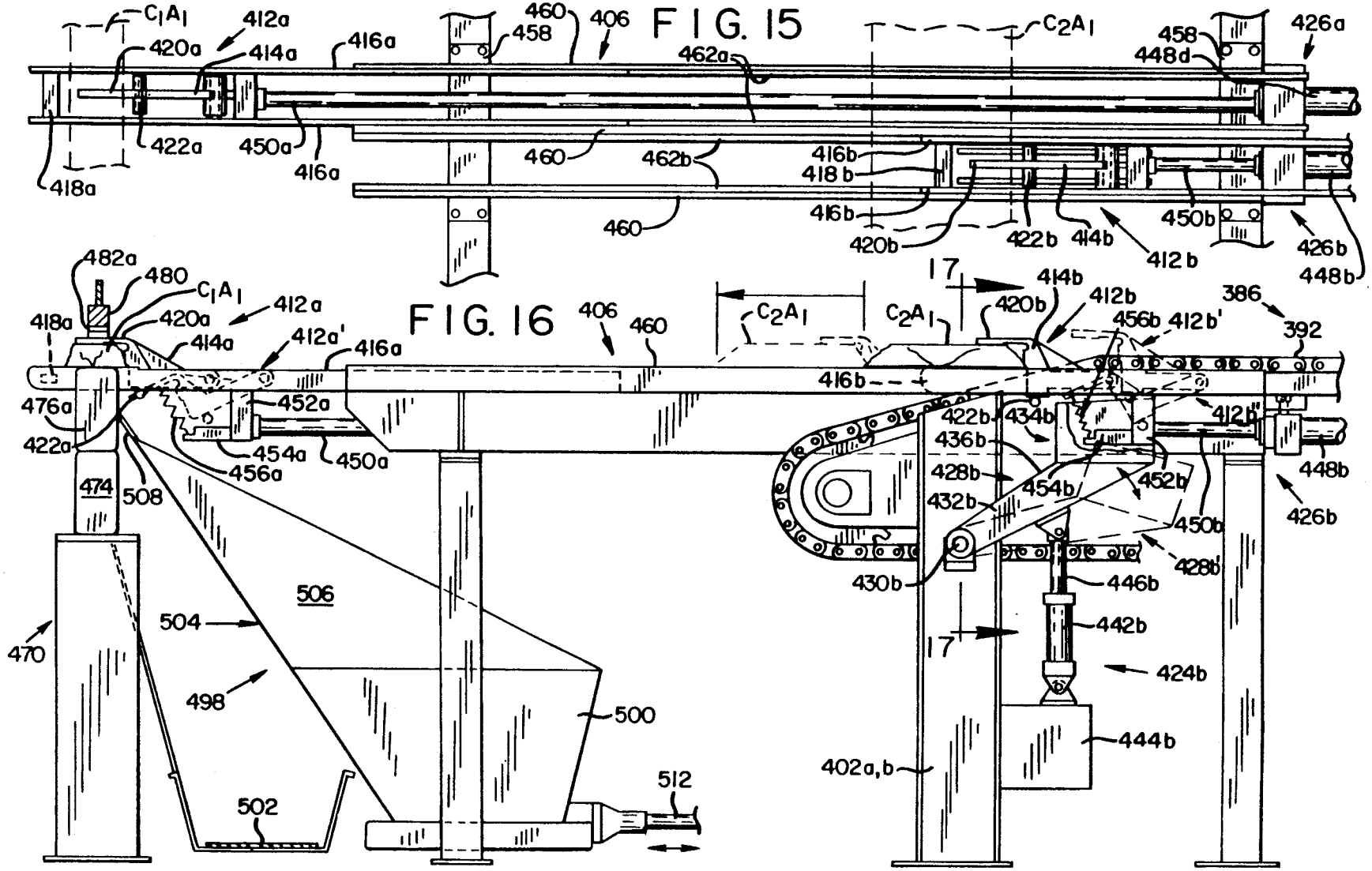

FIG. 15 is a plan view of one side of dead skid 406 including one clamp each of clamp pairs 412*a* and 412*b*. One complete clamp pair comprises clamps on opposite sides of and, except when skewing a cant, will be in corresponding positions along the length of dead skid 406. FIG. 15 illustrates one clamp of a clamp pair 412*a* in an advanced position, and one clamp of a clamp pair 412*b* in a retracted position.

In both FIGS. 15 and 16, clamp pairs 412*a* and 412*b* are in the process of unclamping cant $C_1A_1$ and clamping cant $C_2A_1$. Clamp pairs 412 include clamp holders 414 rotatably attached to clamp travelers 416 which lie in registry within the top surface of dead skid 406 and have clamp traveler struts 418 attached therebetween at the distal ends thereof. Clamp holders 414 can be described as having the approximate shape of a backwards letter "L", having cant grippers 420 extending downwardly from the distal end of the short leg of the "L". On the long side of the "L" there is located a cylindrical clamp pin 422 extending transversely to nearly equal distances on either side of clamp holder 414. These elements can also be seen in FIG. 17, which is a cross-sectional view through one side of dead skid 406.

Clamp pairs 412*a*, 412*b* are operated by respective clamp lifts 424*a*, 424*b* attached to legs 402*a*, 402*b* of pin stop deck 386, and by horizontal travelers 426*a*, 426*b* attached to dead skid 406. One each of the clamp lifts 424*b* and horizontal travelers 426*b* are shown in FIG. 16. Horizontal travelers 426*a*, 426*b* are disposed in mutually parallel relation along the length of dead skid 406, and are seen in respective advanced and retracted positions in FIGS. 15 and 16, i.e., at corresponding distal and proximal ends of dead skid 406.

As illustrated in FIG. 16 clamp lifts 424 include clamp lift arms 428 that are rotatably attached at clamp axles 430 to legs 402 and extend therefrom in the direction of the proximal end of dead skid 406. As can be seen in both FIGS. 16 and 17, clamp lift arms 428 include clamp lift members 432, the proximal ends of which are attached to clamp lift axles 430, and clamp lift cams 434 attached to distal ends of clamp lift members 432.

Each of the clamp lift members 432 includes two mutually facing elongate clamp lift member plates 436*a*, 436*b* that taper to become wider along the length thereof progressively outwardly from clamp lift axles 430, and are held in facing, spaced-apart relationship by clamp lift dividers 438, the distance of the separation being such as to accommodate the length of clamp pins 422 thereabove. Positioned at about a 30° angle to the long axis of clamp lift member plates 436*a*, 436*b* are clamp lift slider plates 440*a*, 440*b*, forming the aforementioned cam 434. The opposite sides of clamp lift slider plates 440*a*, 440*b* are tapered in the direction towards the distal end of dead skid 406 and the tapered upper sides of clamp lift slider plates 440*a*, 440*b* may be brought into contact with clamp pins 422 near respective ends thereof.

Clamp lift actuators 442*a*, 442*b* forming part of clamp lifts 424*a* and 424*b* are rotatably attached to upper surfaces of corresponding clamp lift bases 444*a*, 444*b*, which in turn are attached to the sides of corresponding pin stop deck legs 402*a*, 402*b*. Upon activation of one of clamp lift actuators 442, a corresponding clamp lift rod 446 is caused to move therewithin, being about rotation of the corresponding clamp lift arm 428. In FIG. 16, for example, clamp lift arm 428*b* is shown in a raised position, while a clamp lift arm is shown in outline form in lowered position at 428b'.

The horizontal travelers 426a, 426b include respective clamp traveler actuators 448a, 448b and clamp traveler rods 450a, 450b, the distal ends of the latter being attached to clamp traveler links 452a, 452b which in turn are attached to respective clamp travelers 416a, 416b. The horizontal travelers 426a, 426b serve to move clamp travelers 416a, 416b to desired positions along the length of dead skid 406, e.g., to the positions as shown in FIGS. 15 and 16.

In operation, as illustrated for example in FIG. 14, a pin stop pair 408a may be lowered to such a position that cant $C_3A_1$ can be moved forward (to the left in the drawing) by conveyor 392 so as to progress first onto off-load deck 404 and then onto dead skid 406. Cant $C_2A_1$ in FIG. 14 has already undergone that operation, and has been clamped and moved farther forward. In FIGS. 15 and 16, cant $C_2A_1$ is shown as undergoing the clamping process.

Clamp pair 412b'' is illustrated in outline in FIG. 16 as being in a lowered position behind the course of travel of cant $C_2A_1$. An upward motion of clamp lift arm 428b' (shown in outline) so as to reach the position indicated in full line for clamp lift arm 428b will place cam 434b in contact with clamp pin 422b so as to force clamp pair 412b'' into the position at 412b'. Forward motion of clamp traveler 416b by the action of clamp traveler actuator 448b then places clamp pair 412b' into position 412b, i.e., into a position at which cant $C_2A_1$ will be clamped.

Clamp pairs 412a, 412b further include respective clamp spring arms 454a, 454b extending outwardly from lower portions of clamp traveler links 452a, 452b in the direction of the distal end of dead skid 406. Clamp springs 456a, 456b are located between respective distal ends of clamp spring arms 454a, 454b and respective cant grippers 420a, 420b. The positioning of clamp traveler 416b at the time that clamp pair 412b'' is raised upwardly into position 412b' is such that it is the higher end of the upper, tapered side of cam 434b that encounters clamp pin 422b and thus forces clamp pair 412b' to a high position as shown. The tension of clamp spring 456b is sufficient to maintain clamp pin 422b in position as clamp traveler 416b then moves forwardly. Then, clamp pin 422b drops off the left end of cam 434b, and the tension in clamp spring 456b urges cant gripper 420b downwardly into contact with cant $C_2A_1$. The clamping process by clamp pair 412b as thus completed is set forth in step (x') of the process of FIG. 2 or, equivalently, the clamping of cant $C_1A_1$by clamp pair 412a is set forth in step (w) of the process.

Figure 17:
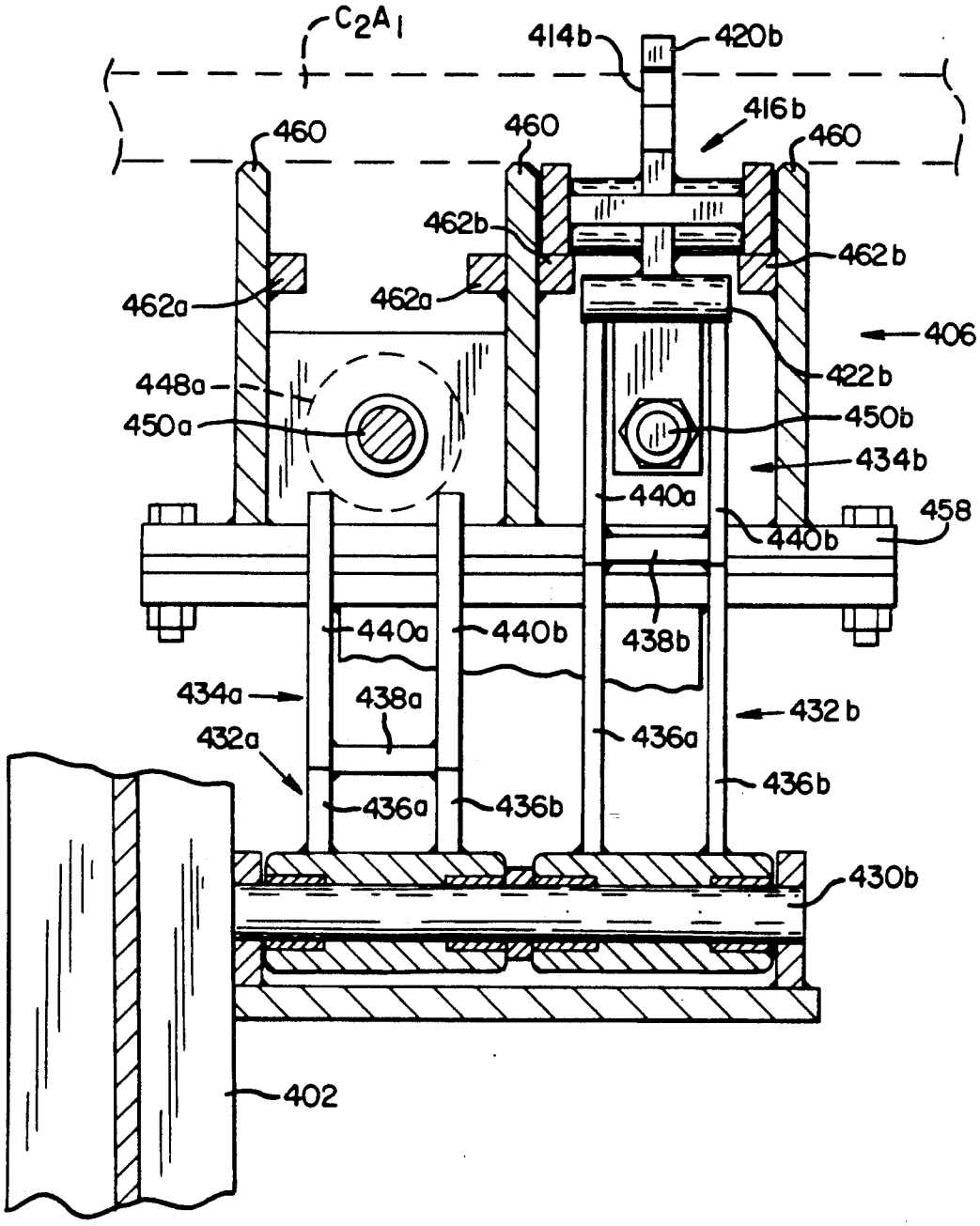

As can be seen in greater detail in FIG. 17, dead skid 406 includes on each lateral side thereof a horizontal dead skid base 458 that supports three laterally spaced and mutually parallel plates 460 separated by a sufficient distance to accommodate clamp travelers 416a, 416b therebetween. Also located between and in this case attached to dead skid plates 460 are respective pairs of clamp traveler rails 462a, 462b disposed along the length of dead skid 406 and also extending laterally therebetween, to provide a sliding surface along which clamp travelers 416a, 416b can be moved. For reasons that will be explained further below, and as can be seen from FIG. 16, clamp travelers 416a, 416b are sufficiently elongate to carry cant $C_1A_1$well forward of dead skid 406 while significant portions of clamp travelers 416a, 416b still remain within dead skid 406.

In FIG. 16, cant $C_2A_1$ is shown in the position as having just been clamped, while in FIG. 14, cant $C_2A_1$ is depicted in a more forward position under scanner 464. To move cant $C_2A_1$ requires forward motion of clamp traveler 416b by clamp traveler actuator 448b.

Subsequent step (y) of the process, i.e., the scanning of a cant, is accomplished by scanner 466. Scanner 466 suitably includes a laser beam source that essentially scans across the cant as the scanner moves with the saw carriage. A television camera, also forming part of the scanner, provides an output according to the cant's lateral dimensions. Scanning data is acquired from scanner 464 and computer means determine therefrom the optimum position and horizontal orientation or skew of a cant so that it can be cut into the maximum amount of lumber. See step (z) of the process of FIG. 2. Also determined are the saw positions for "flying saw" 490 (hereinafter discussed).

The next step (aa) of the process relates to skew positioning of a cant $C_1A_1$ which can also be carried out by horizontal travelers 426a, 426b. Initially, a pair of clamp travelers work in tandem to position a cant for scanning. However, for skewing, the two clamp travelers that control the positions of the opposite ends of a cant $C_1A_1$ work differentially. That is, by moving the two clamp travelers 416a located on opposite sides of dead skid 406 by different amounts, cant $C_1A_1$ may be made to rotate about a vertical axis. That operation constitutes the skew positioning shown as step (bb) of FIG. 2. Steps (aa) and (bb) of FIG. 2 may be carried out simultaneously.

Figure 18:
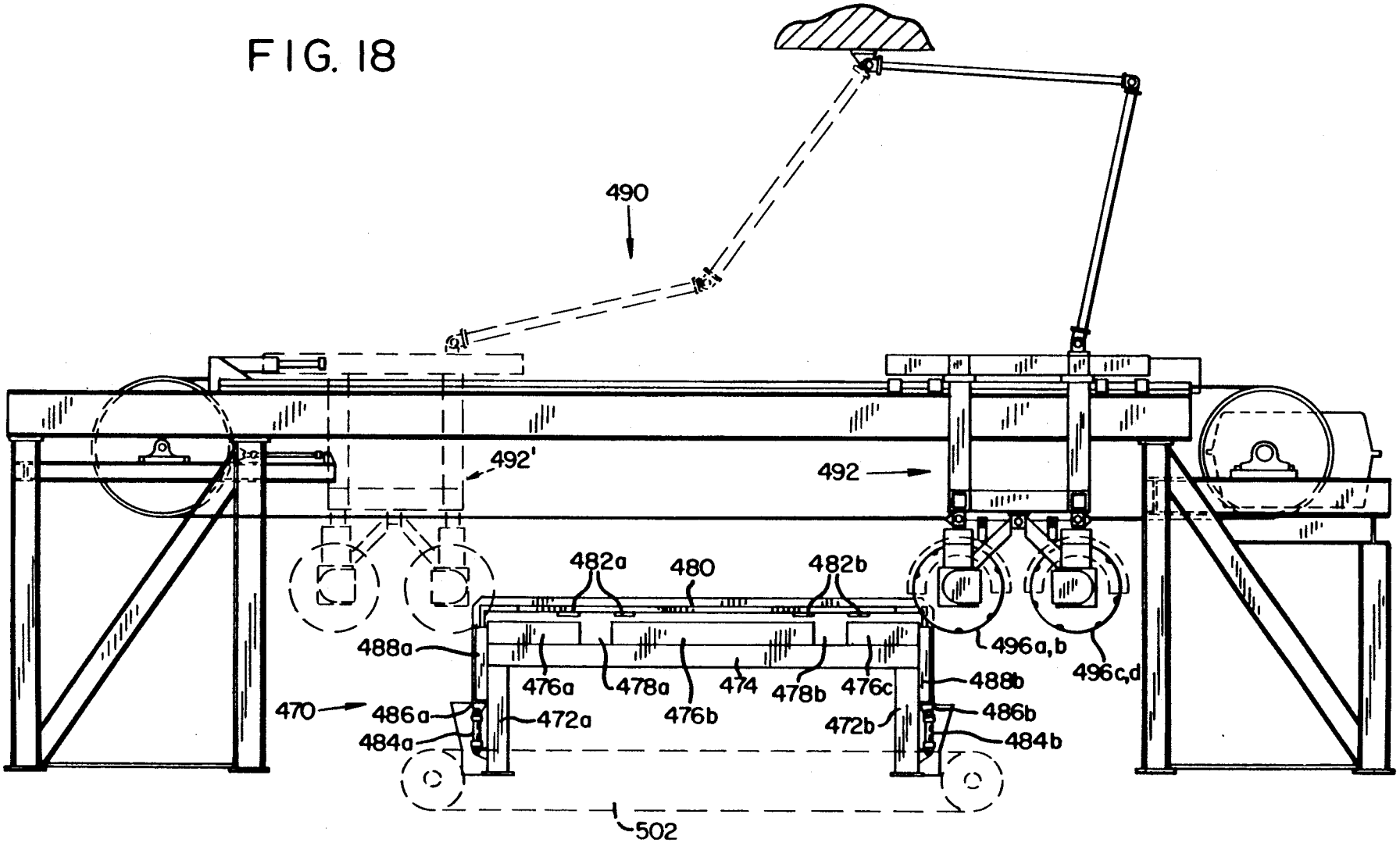

FIGS. 14, 16 and 18 illustrate a holder 470 that serves to hold each cant for sawing. Holder 470 includes vertical struts 472a, 472b and a horizontal strut 474 supported at the top ends thereof. Horizontal strut 474, which is of sufficient length to accommodate a cant, lies transverse to the long dimension of dead skid 406 and is displaced a predetermined distance therefrom. Of course, as can be seen in FIG. 16, that distance must be such that clamp travelers 416a (or 416b) with a cant clamped thereto can extend outward from dead skid 406 to place a cant atop holder 470.

Cant supports 476a, . . . , 476c are attached on top of horizontal strut 474 so as to extend over vertical struts 472a, 472b, and are provided with clamp apertures 478a, 478b located therebetween. The purpose of clamp apertures 478a, 478b is to allow access within holder 470 of a portion of clamp pairs 412a and in particular clamp travelers 416a at a time when a cant, such as cant $C_1A_1$ in FIGS. 15 and 16, is placed upon holder 470.

Holder bar 480 is located over horizontal strut 474 and extends parallel thereto. Attached on the underside of bar 480 are spacer pairs 482a, 482b positioned so that one member of each pair lies immediately adjacent respective clamp apertures 478a, 478b. A cant such as cant $C_1A_1$, lying on cant supports 476a, . . . , 476c, is gripped in that position by bringing bar 480 downward, and spacer pairs 482a, 482b contact the cant. Once gripping of the cant is thus accomplished, members 420a are released from the cant as clamp pairs 412a are withdrawn from the vicinity of holder 470.

As illustrated in FIGS. 14 and 18, holder 470 is operated, i.e., bar 480 is caused to move upwardly or downwardly, by bar actuators 484a, 484b that are attached to outwardly facing sides of vertical struts 472a, 472b, and from within which bar rods 486a, 486b extend. The distal ends of bar rods 486a, 486b are attached to respective bar braces 488*a*, 488*b* which in turn are connected at right angles to opposite ends of bar 480.

When cant $C_1A_1$ has been placed in the position shown in FIGS. 14, 15 and 16, actuators 484*a*, 484*b* are activated so as to bring bar 480 downward against the cant. Thereafter, step (dd') of the process of FIG. 2, which is the unclamping of cant $C_1A_1$, takes place by the withdrawal therefrom of clamp pairs 412*a*. To withdraw the clamp pairs, clamp traveler actuators 448*a* are activated so as to draw clamp travelers 416*a* away from holder 470. Cant grippers 420*a*, which were located atop cant $C_1A_1$, are urged downwardly by clamp springs 456*a*, and upon clamp travelers 416*a* moving a sufficient distance away from bar 480, cant grippers 420*a* and hence clamp pairs 412*a* spring downwardly into positions corresponding to clamp pair 412*a'* in FIG. 16. The gripping of cant $C_1A_1$ by bar 480 is accomplished with sufficient force such that neither the lateral nor skew positioning of the cant will be disturbed by the frictional force of cant grippers 420*a* being withdrawn. Other biasing means such as air cylinders may be substituted for springs 456.

Step (ee') of the process relates to the repositioning of the clamps so as to clamp a subsequent cant that has been placed atop dead skid 406 by pin stop deck 386 and off-load deck 404. That step is accomplished by continuing the motion of clamp travelers 416*a* until clamp pairs 412*a* have assumed positions corresponding to clamp pair 412*b''* in FIG. 16.

That which has been described with reference to lamp pairs 412*a* ($CLAMPS_A$ in FIG. 2) is likewise true of clamp pairs 412*b* ($CLAMPS_B$), such that cant $C_2A_1$ is treated in precisely the same manner as was cant $C_1A_1$ except that the alternate pair of clamp mechanisms is used. Indeed, as is indicated in step (y'') of FIG. 2, cant $C_3A_1$ is treated using the same $CLAMPS_A$ as were used to clamp cant $C_1A_1$, immediately after the completion of step (ee'). By continuing to alternate in using $CLAMPS_A$ and $CLAMPS_B$, a continuous stream of cants is provided, ready for resawing, to holder 470, and the process flow that carries logs $L_i$ through sawmill 10 to produce lumber therefrom continues unimpeded. Sufficient numbers of pin stop decks 386 and additional equipments are provided so as to permit processing all of the cants produced by quad mill 306.

FIGS. 14 and 18 illustrate respective end and side views of a "flying saw" 490 which includes saw traveler 492 of known design. As shown in FIG. 1, several flying saws 490*a*, 490*b*, . . . , equal in number to the number of pin stop decks 386, may be provided in a particular sawmill 10. For the sake of generality, a flying saw suitable for thicker (e.g., 4 or 6 inch) cants is also noted in FIG. 1, and differs from the others principally including scanners capable of viewing side edges as well as the top of thicker cants.

In FIG. 14, a scanner 464 is illustrated as attached to a side of saw traveler 492 nearest dead skid 406. In FIG. 18, it is seen that traveler 492 is caused to move between the position shown in full line and the position shown in outline at 492', thus to traverse past the full length of holder 470 and of any cant held thereby. By this means, while employing scanner 464, the scanning step (y) of the process of FIG. 2 is carried out (while a previous cant, if one is present, is cut) in such a way that the cant being scanned remains motionless and it is the scanner 464 that is caused to move. An accurate scan of the cant is thereby obtained.

Final sawing of each cant is provided by vertical rotary saws 496*a*, 496*b* and 496*c*, 496*d* forming part of traveler 492 as shown in FIGS. 14 and 18. The two pairs of saws indicated are slidably disposed in a facing relation on respective axles in such a manner as to be laterally positioned thereon, in step (cc), under remote control also in response to scanning step (y), and/or according to desired lumber sizes. However, it is noted the system is desirably programmed to limit the motion of saws 496*a*, . . . , 496*d* such that none of them can assume lateral positions corresponding to that of holder 470. Holder 470 has a lateral dimension (at the height of saws 496*a*, . . . , 496*d*) of less than 2 inches, so that even a narrow cant such as cant $C_1A_1$ can be held in a proper lateral position and proper skew to be sawed, i.e., to have its waney edges removed.

The manner in which sawing and scanning operations cooperate can be appreciated from FIG. 14, in which saw traveler 492 is illustrated in a position (in front of cant $C_1A_1$) Scanner 464 is thus located at the near end of cant $C_2A_1$. Upon traveler 492 being caused to move to the far end of flying saw 490 so as to assume the position shown at 492 in FIG. 18, cant $C_1A_1$ will be sawn while cant $C_2A_1$ is scanned. Further, as an example of the cooperative process, the sawing of cant $C_2A_1$ ad the scanning of cant $C_3A_1$ are indicated as occurring simultaneously in steps (ff) and (ff') of FIG. 2.

Upon completion of the sawing of cant $C_1A_1$, as above indicated, cant $C_2A_1$ is placed on holder 470, cant $C_3A_1$ is positioned for scanning, and rotary saws 496*a*, . . . , 496*d* are repositioned on their respective axles and the simultaneous sawing of the former and scanning of the latter takes place. In this way not only is each cant scanned by an alternating back-and-forth motion of traveler 492, but also successive cants are sawn by the same motion. The lateral positions of the respective pairs of rotary saws 496*a*, 496*b* and 496*c*, 496*d* are controlled such that, regardless of the direction of travel of traveler 492, the pair of saws that is first encountered is placed outermost so as to remove the wanes from the cant, while the other pair of saws is placed inwardly so as to perform other cuts as may be required. Of course, in the case of a narrow cant such as cant $C_1A_1$ shown in FIGS. 15, 16 and 18, one pair of saws is used to remove the wane.

Step (ee'') of the process shown in FIG. 2 requires that the wanes and boards produced by sawing a cant be separated. The manner of that separation can be seen from FIG. 16. Wane removers 498 lying parallel to holder 470, comprise elongate trough-like structures or bins with one such remover suitably being located on each side of holder 470. Each, in cross-section, approximates an isosceles triangle oriented such that the smaller angle is located near the top of holder 470. Wane removers 498 include elongate wane bases 500 into which the wanes can fall. Alternatively, bases 500 may be open on the bottom for emptying scrap into removal means, not shown. Between the wane bases, and facing sides of holder 470, are lumber conveyors 502 which can receive the boards from each sawing.

The sides of the wane removers facing lumber conveyors 502 are extended upwardly to near the top of the holder so that angles of approximately 60° to the horizontal are described by inner walls 504 so that wanes sawn in the vicinity of holder 470 will be caused to fall into respective wane bases. End walls 506 terminate just short of ends of inner walls 504 nearest to the holder where portions of inner walls are thickened so as to provide wane lips 508 that first receive the wanes produced from sawing a cant.

The wane removal action is selectively accomplished by operation of wane remover actuators 512 rotatably attached to wane bases 500. The wane remover actuators are empowered by means not shown which translate wane bases 500 on tracks (not shown) whereby wane lips 508*a*, 508*b* become placed in positions, at the time of sawing, at the outer sides of respective saws 496*a*, 496*b* or 496*c*, 496*d* then employed to remove wanes from a cant. That is, when a cant has been positioned and skewed for sawing, the lateral positions at which wane cuts will be made are determined for setting the saws, and wane lips 508 are positioned to receive the wanes produced. The wane removers are then translated away from holder 470 so that sawn lumber can be received on conveyors 502*a*, 502*b* when bar 480 is moved upwardly. The separation of wanes and boards that constitutes step (ee″) of the process in FIG. 2 is thus carried out. The wanes are removed from the mill, step (ff″), and the reduction of a log $L_i$ to lumber by sawmill 10 is complete.

While preferred embodiments of the present invention have been shown and described, it will be apparent to those skilled in the art that many changes and modifications may be made thereto without departing from the invention in its broader aspects. In particular, the present invention incorporates no special limitations as to the size of logs that it can accommodate, or in the types of lumber it can produce. Such matters as various dimensions stated, or the numbers of saws in a particular location, are intended to serve only as examples and may be varied without departing from the import of the invention. Also, as mentioned previously, the sawmill according to the present invention is adapted to employ second and third flying saws, and other duplicatory elements, for substantially increasing the overall lumber output. In addition, a second carriage, substantially identical to the first but the mirror image thereof, may be employed on the opposite side of the charger to receive logs therefrom. The appended claims are therefore intended to cover all such changes and modifications as fall within the true spirit and scope of the invention.

We claim:

1. A method of sawing logs comprising:

gripping a log at ends thereof and sawing the same lengthways into two sections each having the same length as the log, rotating the log to deposit a first of said sections flat side down, sawing the first section into further horizontal pieces with respect to a predetermined level on which said flat side rests, further rotating the second of said sections and depositing the second section flat side down, and sawing said second section into further horizontal pieces with respect to a predetermined level on which the flat side of the second section rests.

2. The method according to claim 1 wherein said log is initially gripped at opposite ends of the part which comprises the second of said sections, the first of said sections being sawn therefrom.

3. A method of charging a sawmill carriage comprising:

depositing a plurality of logs seriatim onto a V-shaped charger base, gripping each of said logs and moving the same substantially vertically to a sawing level where said logs can be gripped by a horizontally offset carriage, measuring each log, wherein each end of a log is moved vertically to said sawing level in accordance with the measurement made, sawing said logs horizontally by moving a log into a horizontal saw to open a face between portions of said log, and depositing a portion of said log from said carriage face down onto a horizontal bed plate for further sawing with reference to said bed plate.

4. In a sawmill for receiving and sawing a plurality of logs, a log handling apparatus comprising:

measuring means for measuring said logs, a charger means comprising a pair of independently operable grapples for engaging a single log at spaced locations therealong, portions of the grapple arms engaging bottom portions of the log, and moving said log from a first stationary position to a sawing level, including differential vertical movement of said grapples in response to measurement of said single log by said measuring means and in accordance with a predetermined lumber output that can be cut from said log, said lumber output being responsive to the measurement by said measuring means, at least one horizontally movable log carriage provided with a pair of dog arms swingable in a horizontal plane and respectively carrying dogs for engaging ends of said single log as carried by said grapples to said sawing level, and for removing said log from said grapples by said carriage, said carriage having a movable frame horizontally offset from the location of a line between said grapples, and from which said arms swing in cantilever fashion to engage said log, a saw disposed proximate the path of said carriage and including a horizontally positioned blade for horizontally sawing said single log into first and second pieces as said carriage moves said log relative to said saw, horizontal log piece receiving means, and means for rotating said dogs after sawing of said single log by said saw for depositing a first piece flat side down onto said receiving means while the second piece remains engaged between said dogs.

5. The apparatus according to claim 4 including means for disengaging said dogs from said second piece for depositing said second piece flat side down on said receiving means.

6. The apparatus according to claim 5 wherein said receiving means includes conveying means and a bed plate disposed at a predetermined level.

7. The apparatus according to claim 6 further including a plurality of band saws disposed above said bed plate and having blades positioned in horizontal planes above and parallel to said bed plate, said band saws being closely spaced along the length of said receiving means for successively engaging the same log piece on said bed plate as driven by said conveying means for cutting the same into cants.

8. The apparatus according to claim 7 including means for adjusting the vertical positions of said band saws above said bed plate in response to said measuring by said measuring means and in accordance with a predetermined lumber output that can be cut from said log, said lumber output being determined by the measurement of said measuring means.

9. The apparatus according to claim 8 including means for moving selected ones of said band saws substantially above said receiving means for servicing.

10. The apparatus according to claim 9 including means for at least partially enclosing said band saws.

11. The apparatus according to claim 10 including means for withdrawing sawdust from said enclosing means.

12. The apparatus according to claim 7 further including conveying means for receiving cants cut by said band saws, pairs of clamping members engaging said cants from said conveying means for positioning said cants forwardly, moveable saw means including multiple saw members for sawing said cants as positioned by said clamping members into lumber including cutting the wane therefrom, and holding means located between said multiple saws for engaging the cants positioned by a said clamping members enabling removal of said clamping members and sawing by said moveable saw means.

13. The apparatus according to claim 12 including wane removers located adjacent the path of said moveable saw means, said wane removers being moveable in a direction perpendicular to the path of said saw means for alternately receiving wanes from said cants and permitting passage of sawn lumber.

14. In a sawmill, apparatus comprising:

conveying means for successively receiving sawn cants, pairs of differentially operable clamping members for engaging said cants from said conveying means and for positioning said cants forwardly, movable saw means including multiple saw members for sawing said cants as positioned by said clamping members into lumber including cutting the wane therefrom with said cants in stationary position, traveler means for carrying said cants towards the movable saw means with said clamping members in engaging relation with cants carried by said traveler means, cam means for raising said clamping members above a said cant to engage a said cant with forward movement thereof, and holding means located between said multiple saw members for engaging the cants positioned by said clamping members enabling removal of said clamping members followed by sawing by said movable saw means, said clamping members being biased toward a said cant further enabling said removal of said clamping members.

15. In a sawmill for receiving and sawing a plurality of logs, a log charger comprising:

a log charger base formed from a plurality of parallel spaced substantially rigid braces provided with upwardly oriented V-shaped slots for receiving a single log at a time, including a pair of spaced braces with substantially aligned slots located at a first predetermined level, and a third brace intermediate said pair of braces, said third brace having a slot at a level lower than said first predetermined level, means for dropping a single log by gravity onto said braces whereby a curved log will become aligned at a predetermined angle relative to the horizontal by virtue of encountering the relative heights of said braces as the log falls, and means for removing said single log upwardly from said base.

16. The charger according to claim 15 further including means for measuring said single log, and wherein said means for removing said single log comprises a pair of independently operable vertically movable grapples for engaging said single log at spaced locations therealong and moving said log to a sawing level in response to said measurement.

17. The apparatus according to claim 16 wherein said measuring means comprises means for scanning said single log when said single log is at a stationary position in said grapples intermediate said braces and said sawing level.

18. The apparatus according to claim 16 wherein each said grapple includes at least a pair of opposed, curved grapple arms, said grapple arms being of sufficient dimension for grasping said single log horizontally in substantially surrounding relation.

19. In a sawmill for receiving and sawing a plurality of logs, a log handling apparatus comprising:

measuring means for measuring said logs, and a charger means comprising a pair of independently operable grapples, said grapples having curved opposed arms for engaging a single log at spaced locations therealong wherein portions of the arms engage bottom portions of said log, and moving said log from a first stationary position to a sawing level, including differential vertical movement of said grapples in response to measurement of said single log by said measuring means and in accordance with a predetermined lumber output that can be cut from said log, said lumber output being determined by the measurement of said measuring means.

20. The apparatus according to claim 19 further including at least one horizontally movable log carriage provided with a pair of dog arms swingable in a horizontal plane and respectively carrying dogs for engaging ends of said single log as carried by said grapples to said sawing level, and for removing said log from said grapples by said carriage, said carriage having a movable frame horizontally offset from the location of a line between said grapples, and from which said arms swing in cantilever fashion to engage said log.

21. The apparatus according to claim 20 including a pair of said carriages, one disposed on each side of said charger means for alternately receiving logs therefrom.

22. The apparatus according to claim 20 including a saw disposed proximate the path of said carriage and including a horizontally positioned blade for horizontally sawing said single log into first and second pieces as said carriage moves said log relative to said saw.

23. The apparatus according to claim 22 wherein said saw comprises a band saw having a blade disposed at a small horizontal angle with respect to a line perpendicular to the path of said log, said angle being substantially less than ninety degrees.

24. The apparatus according to claim 19 wherein said grapples further include bars for bearing on said single log from above as said arms engage said log from underneath.

25. In a sawmill for receiving and sawing a plurality of logs, a horizontally movable log carriage provided with a pair of dog arms respectively carrying dogs for engaging ends of a log and for moving said log horizontally, a saw disposed proximate the path of said carriage and including a blade for horizontally sawing said log into first and second pieces as said carriage moves said log relative to said saw, horizontal log piece receiving means, and means for rotating said dogs after sawing of said log by said saw for depositing a first piece flat side down onto said receiving means while the second piece remains engaged between said dogs.

26. The apparatus according to claim 25 including means for disengaging said dogs from said second piece for depositing said second piece flat side down on said receiving means.

27. The apparatus according to claim 26 wherein said receiving means includes conveying means and a bed plate disposed at a predetermined level.

28. The apparatus according to claim 27 including horizontal saw means for sawing said pieces above said bed plate.

29. In a sawmill, apparatus for sawing log pieces horizontally, comprising:

a horizontal bed plate, means for moving log pieces on said bed plate, and a plurality of band saws disposed above said bed plate and having blades positioned in horizontal planes above and parallel to said bed plate, the path of said blades being entirely above said bed plate, said band saws being closely spaced along the length of said bed plate for successively engaging a log piece on said bed plate as driven by said moving means.

30. The apparatus according to claim 29 including log measuring means and means for adjusting the vertical positions of said band saws above said bed plate in response to measurement by said measuring means and in response to a predetermined lumber output ascribed to a log piece according to measurement by said measuring means.

31. The apparatus according to claim 30 including means for moving selected ones of said band saws substantially above said bed plate for servicing.

32. The apparatus according to claim 31 including means for at least partially enclosing said band saws.

33. The apparatus according to claim 32 including means for withdrawing sawdust from said enclosing means.

34. The apparatus according to claim 29 wherein said band saws are of narrow dimension along the path of said log pieces, said band saws being provided with motor drive means located at alternate ends on successively adjacent band saws.

35. The apparatus according to claim 29 wherein said means for moving log pieces on said bed plate comprises a conveyer disposed along said bed plate carrying a plurality of pusher bars located adjacent said bed plate for urging said log pieces toward said band saws.

36. The apparatus according to claim 35 wherein a band saw first encountered by a log piece is farther away from said bed plate than a band saw subsequently encountered by the same log piece in passing along said bed plate, and including means for urging said log piece down on said bed plate.

37. In a sawmill, apparatus comprising:

conveying means for successively receiving sawn cants, pairs of differentially operable clamping members for engaging said cants from said conveying means and for positioning said cants forwardly, said clamping members comprising cant grippers for releasably engaging said cants from above, moveable saw means including multiple saw members for sawing said cants as positioned by said clamping members into lumber including cutting the wane therefrom with said cants in stationary position, and holding means located between said multiple saw members for engaging the cants positioned by said clamping members enabling removal of said clamping members followed by sawing by said moveable saw means.

38. The apparatus according to claim 37 including wane removers located adjacent the path of said moveable saw means, said wane removers being moveable in a direction perpendicular to the path of said moveable saw means for alternately receiving wanes from said cants and permitting passage of sawn lumber.

* * * * *

UNITED STATES PATENT AND TRADEMARK OFFICE

CERTIFICATE OF CORRECTION

PATENT NO. : 5,088,363

DATED : February 18, 1992

INVENTOR(S) : Aaron U. Jones, et al.

It is certified that error appears in the above-identified patent and that said Letters Patent is hereby corrected as shown below:

Column 1, lines 20, 21, "economically In" should read --econmically. In--.

Column 1, line 38, "as disc U.S." should read --as disclosed in U.S.--.

Column 7, line 21, "66a,., 66c" should read --66a, ..., 66c--.

Column 9, line 12, "log $L_i$In fact," should read --log $L_i$. In fact,--.

Column 9, line 40, "$L_i$Longitudinal" should read --$L_i$. Longitudinal--.

Column 10, line 20, "148a,., 148d" should read --148a, ..., 148d--.

Column 10, line 22, "$L_i$FIG. 5A" should read --$L_i$. FIG. 5A--.

Column 10, line 23, "54f" should read --154f--.

Column 10, line 42, "$L_i$with" should read --$L_i$ with--.

Column 11, lines 49, 50, "carrier" should read --carriage--.

Column 14, line 17, delete the comma (,) after "$3^o$".

UNITED STATES PATENT AND TRADEMARK OFFICE

CERTIFICATE OF CORRECTION

PATENT NO. : 5,088,363

DATED : February 18, 1992

INVENTOR(S) : Aaron U. Jones, et al.

It is certified that error appears in the above-identified patent and that said Letters Patent is hereby corrected as shown below:

Column 20, line 66, "being" should read --bringing--.

Column 23, line 31, "lamp pairs" should read --clamp pairs--.

Column 24, line 20, "cant $C_1A_1$) Scanner" should read --cant $C_1A_1$). Scanner--.

Column 24, line 26, "ad the" should read --and the--.

Column 28, line 55, "claim 20 including" should read --claim 20 further including--.

Signed and Sealed this

Fourth Day of January, 1994

*Attest:*

*Attesting Officer*

Bruce Lehman

BRUCE LEHMAN

*Commissioner of Patents and Trademarks*